US005123326A

United States Patent [19]

Clevinger

[11] Patent Number: 5,123,326

[45] Date of Patent: Jun. 23, 1992

[54] STRING MUSICAL INSTRUMENT WITH TONE ENGENDERING STRUCTURES

[76] Inventor: Martin Clevinger, 465 40th St., #A, Oakland, Calif. 94609

[21] Appl. No.: 502,295

[22] Filed: Mar. 30, 1990

[51] Int. Cl.[5] ..... G10M 3/00; G10D 1/02

[52] U.S. Cl. ..... 84/743; 84/DIG. 24; 84/723

[58] Field of Search ..... 84/743, 723, 724, 725, 84/730, 742, DIG. 24

[56] References Cited

U.S. PATENT DOCUMENTS

| | | | |
|---|---|---|---|
| 3,600,496 | 8/1971 | Ellis | 84/726 |
| 3,725,561 | 4/1973 | Paul | 84/726 |
| 4,030,396 | 6/1977 | Mariner | 84/DIG. 24 |
| 4,147,084 | 4/1979 | Underwood | 84/DIG. 24 |
| 4,242,938 | 1/1981 | van Zalinge | 84/743 |
| 4,785,704 | 11/1988 | Fishman | 84/DIG. 24 |
| 4,823,668 | 4/1989 | Marrs | 84/267 |
| 4,867,027 | 9/1989 | Barbera | 84/DIG. 24 |
| 4,867,030 | 9/1989 | Smith | 84/299 |
| 4,899,634 | 2/1990 | Geiger | 84/307 |

OTHER PUBLICATIONS

*Guitar Player*, Jul. 1987, p. 113.
*Guitar Player*, Aug. 1988.
*International Society of Bassists*, Fall 1988, p. 11.
*Bass Player*, Oct. 1989, p. 74.
*International Society of Bassists*, Fall 1989, p. 56.
*International Society of Bassists*, Spring 1989, p. 24.

*Primary Examiner*—William M. Shoop, Jr.
*Assistant Examiner*—Helen Kim
*Attorney, Agent, or Firm*—Limbach & Limbach

[57] ABSTRACT

An improved string musical instrument is disclosed wherein a dynamic tone engendering structure provides adjustable filtering and conditioning of each of the variously tuned string's vibrational behavior. Acoustic energy transmission paths are provided for the overtone and fundamental tone components produced by the variously tuned strings, assuring even transmission of each string's particular acoustical energy to acoustical summing nodes where transducers convert acoustical energy to electrical energy. The present invention closely emulates the characteristic dynamic response and musical timbres found in a wide variety of traditional acoustic instruments.

61 Claims, 22 Drawing Sheets

C.L. 76

2
3
4
5
6
7
14a
22
22a
23
27b
30
35
37
38
43
53
54
58
60
62c
63
64
65
100
127
128
131
132
133
134
135
136
137
138
139
140
141

STRING MUSICAL INSTRUMENT WITH TONE ENGENDERING STRUCTURES

TECHNICAL FIELD

The present invention relates generally to string musical instruments and more particularly string musical instruments which are intended for electrical sound amplification.

BACKGROUND ART

In the past, many electric string instruments have been devised, among these are string instruments which have employed substantially rigid body construction. However, while solving problems of durability and loudspeaker feedback, such string musical instruments have not provided the dynamic playing response or tonal qualities expected from fine acoustic instruments. This is due in part to the lack of acoustical interaction between the strings, body, and neck structures of such rigid instruments. In these rigidly constructed string instruments, the energy imparted to the strings during performance is confined substantially to the strings and is unable to extend beyond the capacity of the string's maximum excursion. Thus, the dynamic range of such rigidly constructed instruments is limited, particularly in response to vigorous playing. Further, such rigid structures tend to store rather than dissipate higher frequency acoustical energy and thus display undesirable reverberation and resonances at audible frequencies. U.S. Pat. No. 3,769,871 to Joel Cawthorne, U.S. Pat. No. 4,192,213 to Ned Steinberger and U.S. Pat. No. 4,632,002 to Martin Clevinger, the inventor herein, are examples of these rigid body instruments.

In the present invention, accurate emulation of traditional string musical instrument behavior is achieved by assuring that elastic energy storage and damping characteristics provided by the present invention closely parallel those of the finest traditional acoustic string instruments wherein the bridge, soundboard, body and neck are increasingly set into vibrational excitation as the dynamic level of the string vibration is increased during performance. However, the present invention achieves the acoustical parameters through use of a novel tone engendering structure.

Many electric string musical instruments of the past have employed magnetic sound pickup devices. Most of these prior art systems generate electrical signals resulting from changes in the reluctance path of a magnetic field. Usually the strings are within the reluctance pathway, therefore movement of the strings causes changes in the reluctance path. These changes cause the intensity of the magnetic field to vary. These variations are sensed by magnetic field sensing means which produce electrical currents proportional to the variations. Usually a coil is used to produce electrical current in response to changes in magnetic field intensity.

The playing response and sonic quality produced by such variable reluctance pickups bear little resemblance to the playing response and sonic quality of acoustical instruments. The dynamic range provided by these pickups is insufficient to enable the player to achieve the full range of musical expression as is expected from quality acoustic instruments.

Many variations of magnetic pickup systems have been attempted. Some have mechanically coupled magnets or coils mechanically coupled to string bridge devices to simulate the timbre of acoustical instruments.

Due to shortcomings in their mechanical structures and known problems including various inductive effects and noise inherent in these systems, sonic and performance qualities resembling those of acoustical musical instruments were never fully realized by these variable reluctance pickup systems.

Other string musical instruments, which in the past have used piezo electric materials in close mechanical coupling with vibrating strings, have not convincingly emulated the sound quality of acoustic instruments. Such instruments have generally employed string saddles or bridges under the pressure of the strings and bearing upon piezo electric materials. An example of this can be found in U.S. Pat. No. 4,491,501, to Lester M. Barcus. These saddles or bridges closely coupled the strings to piezo materials and produced signals analogous to changes in pressure upon the piezo elements. The output signal produced by these pressure changes was substantially devoid of acoustic effects which occur in elastic vibratile structures such as the bridge, soundboard, body and neck in traditional acoustic instruments. Typically audio signals produced by each independent string were mixed electrically. This resulted in a composite electrical signal mixdown of each string's isolated acoustic information, wherein the acoustical communication among strings through a common elastic structure, such as occurs in acoustic string instruments, was noticeably absent.

Unnatural over-emphasis of low amplitude sounds produced by bow friction or finger and plectrum impacts upon the strings were typical of closely coupled piezo systems. Further, the dynamic range of these closely coupled piezo systems was limited as the signal produced was confined to pressure changes caused solely by the vibration of the strings.

Attempts to enable vibrating strings to interact with certain vibratile structures mounted upon various solid or non-acoustic bodies are known. U.S. Pat. No. 4,635,523 to William Merchant used a traditional bass violin bridge bearing upon a plurality of elongated bridge supports. This required that the bridge rest upon at least two discrete supports which by their separate nature did not provide acoustical energy communication through a common soundboard in a fashion similar to traditional string instruments. While the location and placement of transducer means was not specified in this prior art string musical instrument, it is apparent that various add-on sound pickup attachments of the type used for amplification of traditional acoustic instruments would be required for electrical amplification, resulting in exposed wiring and vulnerability to damage. Further, the large size and the simple orthogonal shape of the elongate bridge supports introduced unrealistic resonances in the amplified signal. A traditional bridge structure of the type intended for excitation of a conventional acoustic body was used. Experiments have shown that in construction of an electric string musical instrument, a smaller bridge structure is more suitable for transmission of string vibration to electrical sensors. The large traditional bridge stored excessive amounts of acoustic energy which results in unwanted ringing and sonic coloration.

U.S. Pat. No. 4,632,002 to Martin Clevinger employed a compliant hanger structure with a substantially rigid crown in contact with the strings. This device suffered from undesirable resonances due in part to homogeneity and high mass density of the material required for its construction. Further, symmetrical geometry of the hanger structure caused standing waves at specific frequencies and reverberations resulting in undesirable resonant peaks. Since this prior art device substantially restricted acoustical energy to the strings and bridge/hanger structure, the output signal lacked the warmth and complexity expected from acoustic instruments.

Other prior art string instruments have used various bridge structures mounted upon or incorporating resilient materials such as rubber for enabling vibrating strings to produce low frequency displacements of these bridge structures. Among such inventions are U.S. Pat. No. 3,539,700 to Johnson and U.S. Pat. No. 3,113,990 to Zanessi. However, when rubber or similar elastic means were used, disproportionate acoustic energy losses with excessive damping of the strings occurred. An unnatural sound suffering from excessive low frequency transients is typical of such devices.

Other structures such as U.S. Pat. No. 4,607,559 to Richard Armin teaches a traditional violin bridge under tensioned strings bearing upon a carved soundboard acoustically suspended on a sealed cavity to provide sonic qualities similar to acoustic instruments. However, such prior art string instruments which employed hollow acoustic bodies suffered from excessive acoustical loudspeaker feedback as their thin plate construction became undesirably microphonic when the audio output signal was amplified at high levels. Further, these costly instruments were physically delicate and unstable in changing weather conditions. The present invention overcomes the objectionable characteristics and shortcomings of the foregoing while providing a greatly improved electric string instrument. More particularly, the present invention furnishes in an easily transportable durable and economical structure, highly desirable playing qualities similar to those possessed by delicate traditional acoustic instruments which have proved difficult to interface with modern audio equipment as found in broadcast, public address, and recording studio facilities. The present invention is readily adaptable to all modern musical facilities and situations.

The present invention may be applied to all string musical instruments and the benefits of the present invention may be well appreciated in string instruments which are frequently plucked as well as bowed. One example of such an instrument is the string bass. Fine timbre and even playing response at all levels of loudness have previously been available only in the finest traditional bass violins. The present invention achieves the desirable playing attributes of fine traditional bass violins with economy, improved durability, and with the added benefit of ready adaptability to recording, broadcast and public address applications, thus a string bass shall be described herein as an illustrative example of the present invention.

SUMMARY OF THE INVENTION

The problems and disadvantages of prior string musical instruments are overcome by a dynamic tone engendering structure for converting vertical and horizontal vibrational energy received from a plurality of vibrating strings into an electrical signal which is suitable for amplification, comprising a base table which is formed of high mass density material; a sound diaphragm which is supported by the base table and constructed of low mass density material; a bridge assembly which communicates with the plurality of vibrating strings; and transducer means communicating with at least one part of the sound diaphragm for converting vibrational energy from the sound diaphragm into electrical signals.

The sound diaphragm is separated into a plurality of distinct sections by an acoustic boundary slot so that the plurality of distinct sections may have different resonant frequencies and form interactive resonant structures.

Selected portions of the bridge structure are supported on selected ones of the plurality of distinct sections of the sound diaphragm so that vibrational energy from selected ones of the plurality of strings are predominantly transmitted to the selected ones of the plurality of distinct sections of the sound diaphragm.

In a further embodiment of the present invention, the tone engendering structure includes a bridge piece having a first edge positioned to be in contact with the plurality of strings and a second edge separated from the first edge by vibration transmitting material. The bridge piece may have a summing extension or area which protrudes outwardly from the second edge, and the vibration transmitting material includes a plurality of slots which are positioned to steer vibrational energy from selected portions of the first edge toward selected portions of the second edge and the summing extension. Means are positioned to be in contact with the second edge of the bridge piece for supporting the bridge piece on the sound diaphragm. In this embodiment, transducer means are provided to convert vibrational energy from the summing extension into amplifiable electrical signals. This energy is predominantly analogous to vertical displacements of the bridge and sound diaphragm which result from downward thrusts of the vibrating strings. The horizontal wave fronts of vibrating energy, such as are produced by bowing the strings, are also readily converted into amplifiable electrical signals. These horizontal wave fronts cause the bridge structure to move laterally or in a side to side motion. This lateral motion of the bridge is converted to pressure fluctuations affecting at least one transducer for producing amplifiable electrical signals in response to bowing.

In another embodiment of the present invention, the base table includes a first plate of high mass density material, a second plate of high mass density material; and a layer of damping material sandwiched between the first and second plates. It has been found that with such a base table resistance to acoustic loud speaker feedback is improved.

In a still further embodiment of the present invention, the structures which support the bridge piece on the sound diaphragm are adjustable so that the response of the bridge structure can be fine-tuned.

It has been determined that sonic results most closely resembling fine acoustic string instruments are achieved through use of acoustical systems which allow interaction between the strings and excitable or reactive string support means. This situation is found in traditional acoustical instruments. The elastic energy storage and damping qualities provided by the present invention closely emulate those of the finest acoustic instruments. Further, novel methods for acoustically or mechanically conditioning the vibrational behavior and sound quality of each string, as well as the sum of all the strings are provided, thus the present invention yields even-amplitude among all strings and enables adjustable reaction to and damping of the vibrating strings. These adjustments allow the user to set the adjustable reaction and damping features, and therefore enable emulation of a wide variety of acoustic instrument attributes.

The present invention facilitates desirable behavior of the strings, wherein attack, dynamic response, sustain and decay characteristics may closely resemble those found in fine traditional acoustic string instruments. These attributes assure predictable musical results from known playing techniques at all levels of loudness. Though the present invention allows selection of traditional string behavior and response, if it should be so desired, operating parameters of various structures within the present invention may be easily altered to cause the strings to sustain for shorter or longer duration. Additionally, effective compensations for particularities of each individual string's vibration transmission, and resulting sound may be accomplished. The present invention furnishes these and many other features and advantages as may be more fully understood upon studying the detailed description in conjunction with the accompanying drawings of the present invention.

OBJECTS AND FEATURES OF THE INVENTION

It is therefore an object of the present invention to provide an economical and durable string musical instrument providing playing attributes and sonic qualities which may be adjusted to closely resemble those occurring in a wide variety of acoustic string musical instruments.

It is also an object of the invention to enable conditioning and behavioral control of the string vibration wherein attack, sustain and decay characteristics of the strings are mechanically controlled by the adjustable parameters of the reactive bridge and sound diaphragm structure of the invention.

Another object is to provide an electric string musical instrument which may be adjusted to yield the wider dynamic range associated with acoustic string musical instruments.

It is also an object of the present invention to enable modification and adjustment of the tonal qualities and timbres produced by bowing or plucking the strings, which adjustments are achieved largely through control of acoustical or mechanical energy produced by the strings prior to conversion of these energies to electrical energy.

Yet another object of the present invention is to provide selected sampling points or areas within and upon which acoustical or mechanical energy may be imparted to sensing devices for converting acoustical energy fluctuations into analogous electrical energy fluctuations for furnishing various tonal qualities available at each of the sampling points.

Another object of the invention is to provide mechanical structures for transmitting vibratory energies of both horizontal and vertical wave fronts to piezo elements wherein both horizontal and vertical wave fronts may be added together in an amplified electrical signal, thus emulating the response of acoustical string instruments to both bowed and plucked strings.

A further object of the present invention is to provide mechanical control means for adjusting both the amplitude and frequencies of resonance occurring within structures for transmitting acoustical energy to said sampling points or areas, which sound transmitting structures possess the capability to introduce variable degrees of reverberation and frequencies of resonance into the acoustical energy present at said sampling points, summing nodes or areas.

A still further object of the present invention is to enable adjustment of the amplitude of at least one string with respect to a number of other strings wherein said adjustment may be achieved through mechanical or electrical means or a combination thereof.

BRIEF DESCRIPTION OF THE DRAWINGS

FIG. 4 shows the present invention as applied to a guitar family instrument or the like.

DETAILED DESCRIPTION OF THE INVENTION

In the following description of the present invention, the main objects and features are shown by way of an illustrative example in which a bass violin employing the present invention is described.

Figure 1A:
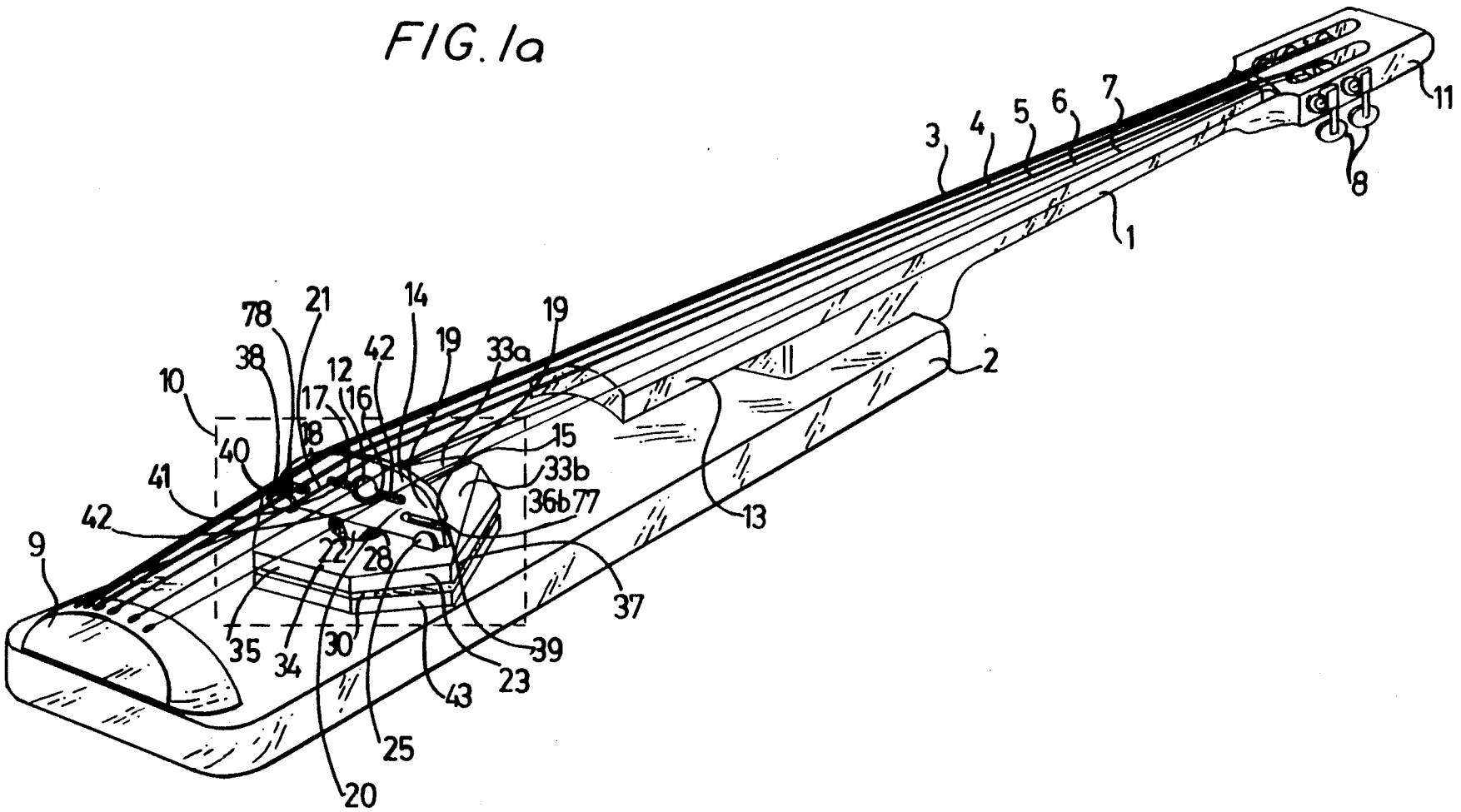
FIG. 1*a* is an orthographic projection of a preferred embodiment of the present invention.
Figure 1B:
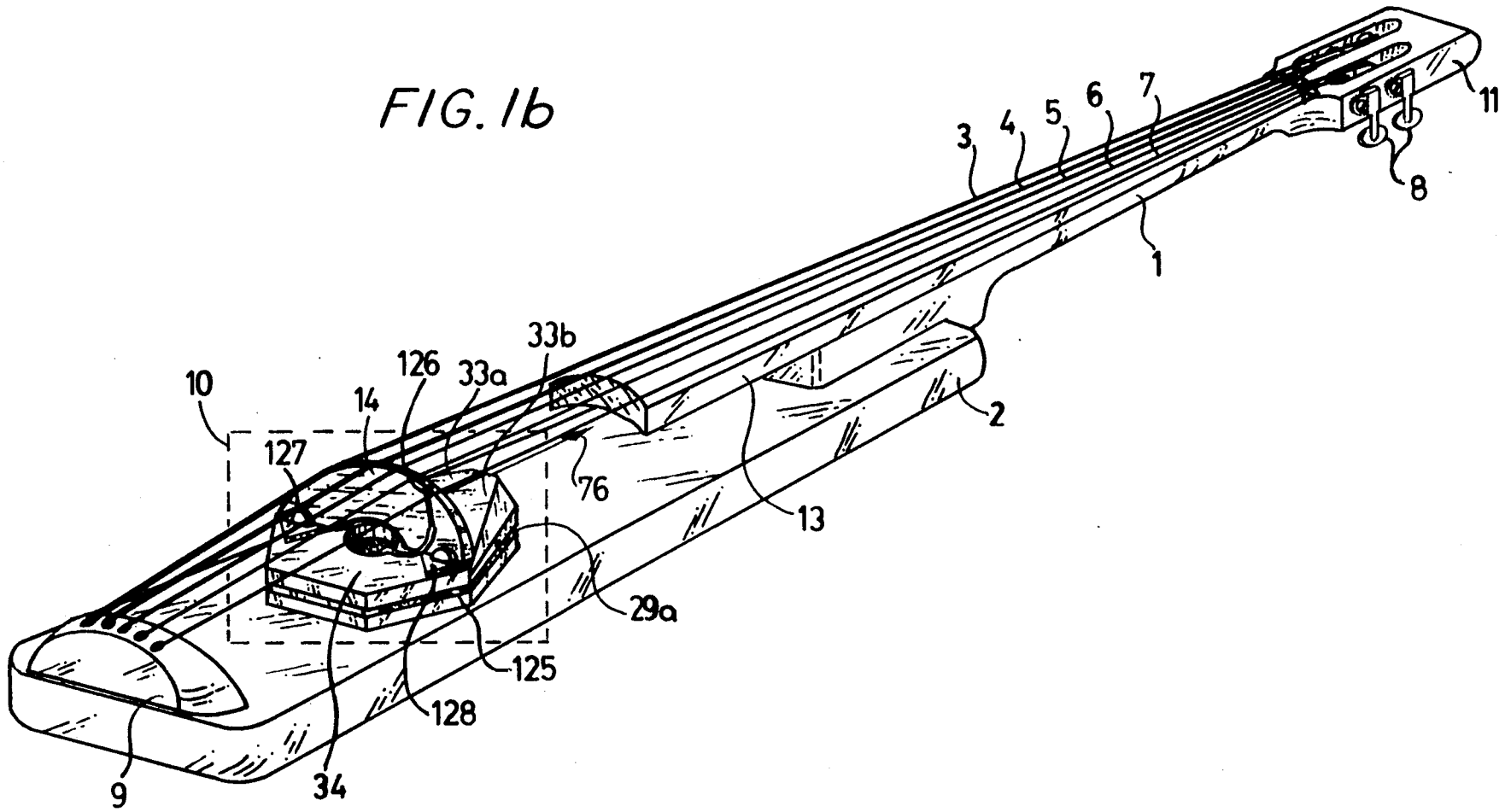
FIG. 1*b* is an orthographic projection of another preferred embodiment of the present invention which incorporates the bridge structure of FIGS. 22–27.

Referring now to FIG. 1*a*, in the preferred embodiment of the present invention, a neck 1, a body 2, and a set of tunable strings 3, 4, 5, 6 and 7 (and 7*a*, FIG. 18, in the case of a six string musical instrument), are tensioned between tuning structure 8 and a tailpiece 9, and over dynamic tone engendering structure 10. This anchors the strings and provides a downbearing tension relationship with dynamic tone engendering structure 10.

Neck 1 can preferably be made of hard, stiff materials such as rock maple and can include a tuning head 11 which supports tuning structure 8 for tuning the strings 3, 4, 5, 6 and 7. Neck 1 can also include fingerboard 13 which is preferably made of wood such as ebony. However, plastics may be substituted for fingerboard 15. The fingerboard 13 is mounted upon neck 1 and extends beyond neck 1, continuing in a spaced relationship above and substantially parallel to body 2 and below strings 3, 4, 5, 6 and 7.

Strings

These strings may be considered generally to be in two categories consisting of lower pitched strings 3 and 4, and higher pitched strings 5, 6, 7 and 7*a*. It is to be clearly understood that the number of strings as well as their tuning may be altered in various ways and still be fully within the scope and spirit of the present invention. These strings are tensioned between tuning structure 8 and tailpiece 9, however, dynamic tone engendering structure 10 is disposed between the body 2 and the strings 3, 4, 5, 6 and 7. Thus, forces exerted by the strings are partially directed downward through dynamic tone engendering structure 10 to body 2.

The pressure exerted by the strings upon dynamic tone engendering structure 10 can be varied by changing the height of tailpiece 9. While variable height adjustment of tailpiece 9 is not required in the present invention for satisfactory operation and is therefore not illustrated herein, it is to be understood that such adjustment is foreseen for tailpiece 9, as well as for each individual string mounted thereupon.

Body

Body 2, in the preferred embodiment of the present invention, may be constructed of woods displaying stiffness-to-weight characteristics which provide the lightest possible weight without compromising the structural and acoustical qualities required by the present invention. Woods such as alder, basswood or poplar exhibit such characteristics. These characteristics include proper damping factors and elastic energy storage qualities for close emulation of traditional acoustic string instruments. Body 2 must be able to maintain its shape while subjected to the combined linear pull of the strings and the resultant force bearing upon body 2 by way of dynamic tone engendering structure 10.

Body Extensions

Figure 4:
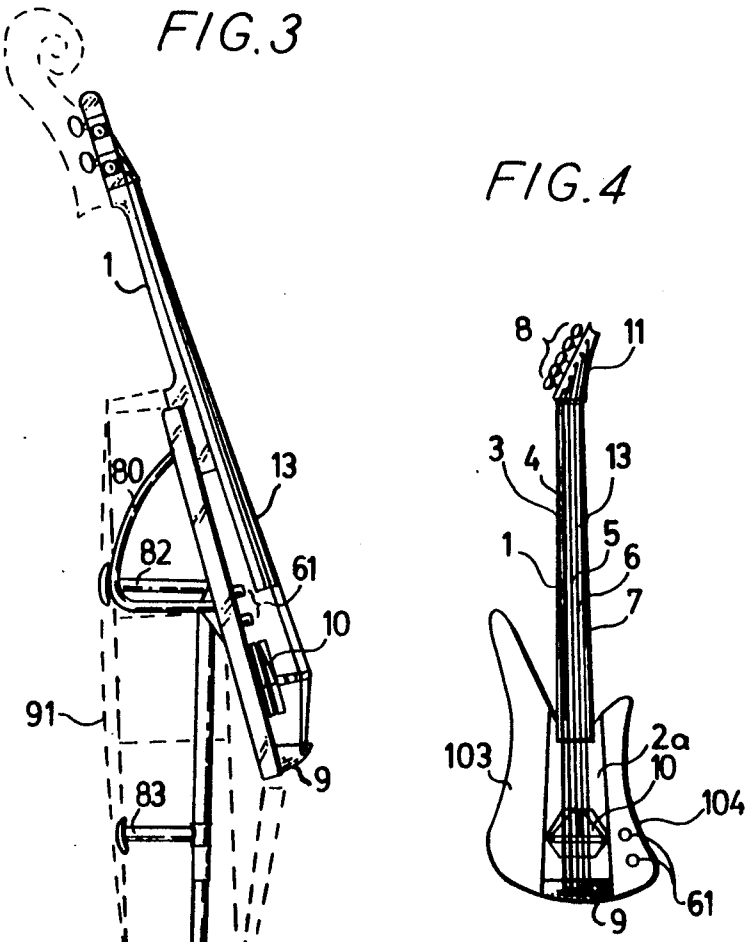
Figure 3:
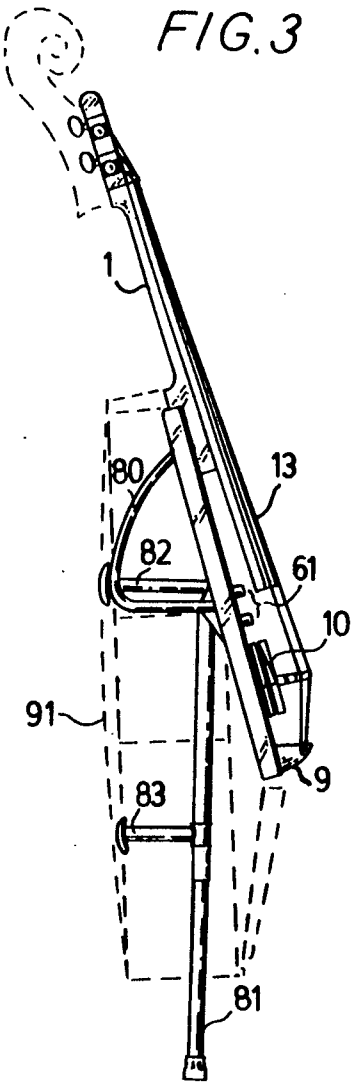
FIG. 3 illustrates one side of a preferred embodiment of the present invention superimposed upon a traditional bass violin represented by the dotted lines.
Figure 2:
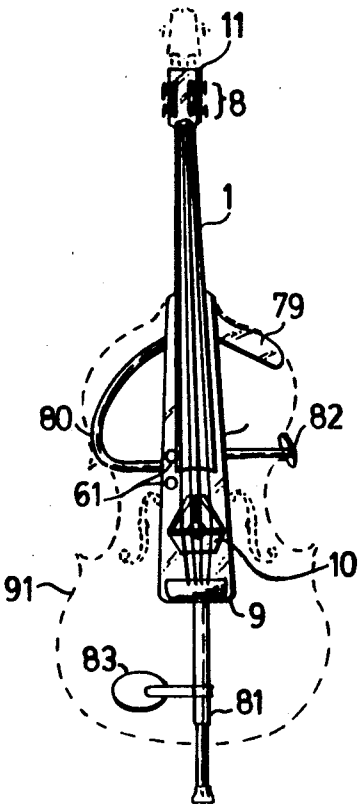
FIG. 2 is a frontal view of a preferred embodiment of the present invention superimposed upon a dotted line representation of a traditional viol or violin family instrument.

Various body extension structures may be employed to provide known player-to-instrument contact areas. Many variations of such body extensions are known. The body extensions shown in FIGS. 2, 3 and 4 are typical of those generally applicable to the present invention in instances of a bass violin, cello and bass guitar. As can be seen in FIGS. 2, 3, and 4, the present invention is shown with various extensions depending therefrom, including a left upper bout extension 79 and a right upper bout extension 80, both of which provide areas of physical interface between the player and the present invention. Additional body extensions may include an adjustable endpin 81 and upper and lower knee rest assembly 82 and 83 which provide the areas of player contact as occur in traditional string instruments. Dotted line 91 represents the outer perimeter of a traditional viol or violin family instrument.

Figure 20:
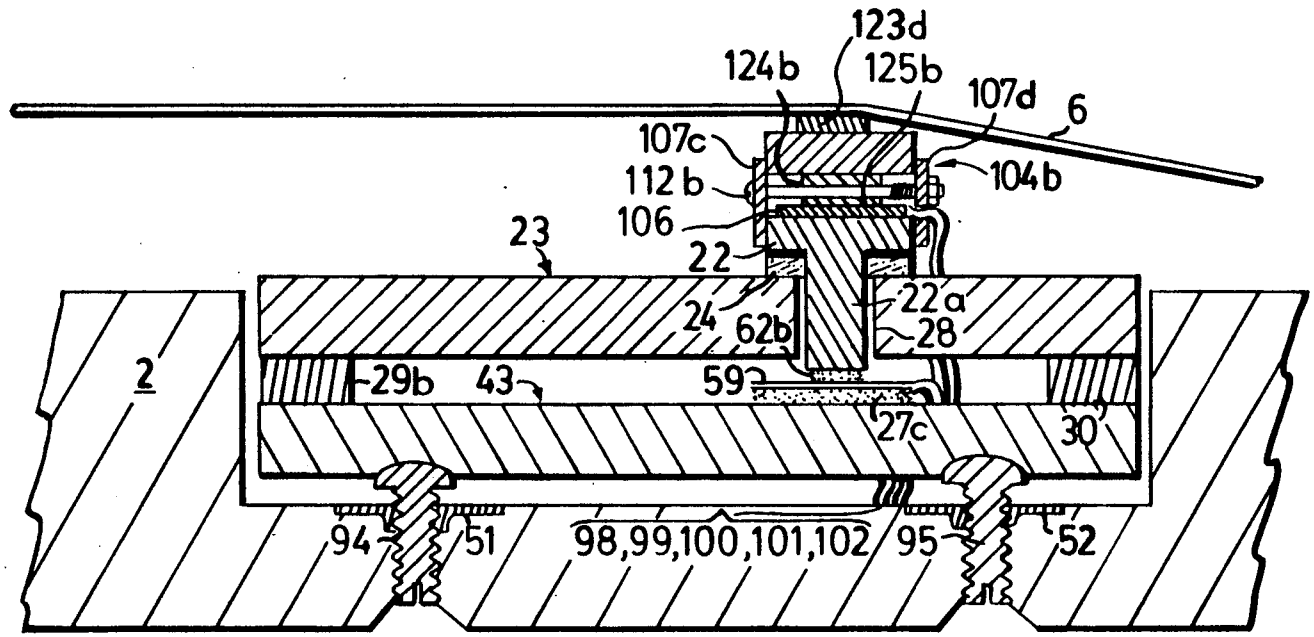
FIG. 20 is a cross sectional view taken on lines B—B and center line 76 showing the dynamic tone engendering means 10 recessed into the body 2 of the present invention.

FIG. 4 shows the present invention as applied to guitar family string musical instruments wherein right bout extension 103 and left bout extension 104 provide the familiar player-to-instrument contact areas. The various body extensions may be either removable or articulated to be folded into compact configurations, as is well known to those skilled in the art. As may be more clearly understood by referring to FIG. 7*a*, dynamic tone engendering structure 10 may be mounted upon the front surface of the body, or may be recessed into the body as shown in FIG. 20 in which a thin profile string musical instrument such as a guitar is constructed according to the present invention.

Dynamic Tone Engendering Structure

Figure 5:
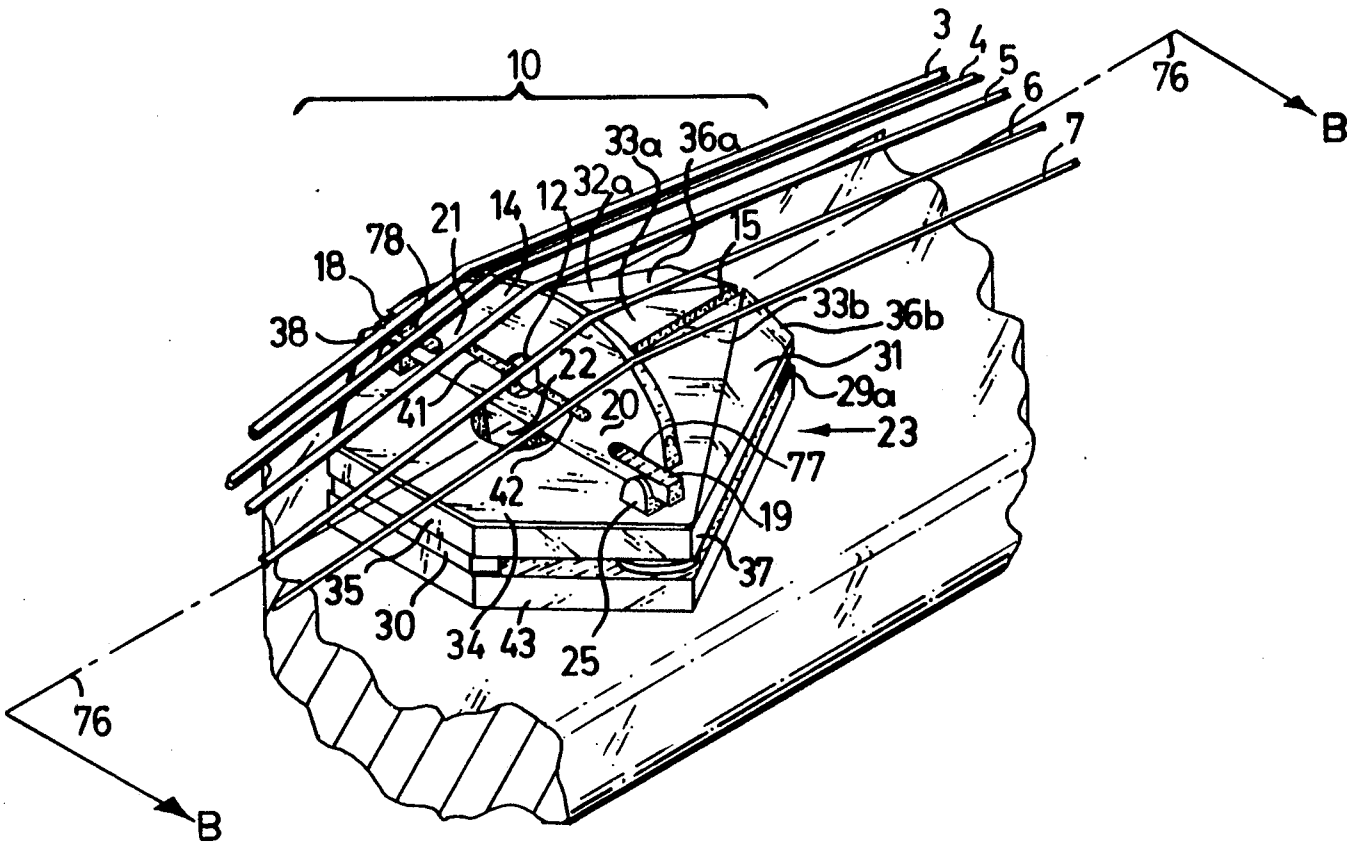
FIG. 5 is a cutaway portion of FIG. 1*a* showing details of the dynamic tone engendering means 10.

Referring now to FIG. 5, dynamic tone engendering structure 10 includes a bridge piece 14, tapered sound diaphragm 23, and base table 43. Base table 43 provides a solid base upon which tapered sound diaphragm 23 rests. As its name implies, tapered sound diaphragm 23 is an interactive resonating structure which is preferably sectioned and configured to respond to and shape the vibrational energy from the vibrating strings. Bridge piece 14 acts as an energy filter and mechanical conduit between the strings and tapered sound diaphragm 23.

Bridge piece 14 can be formed to enable variable conservation and expenditure of the vibratile energy of strings 3, 4, 5, 6 and 7. In this way, bridge piece 14 mechanically filters the acoustical energy traveling through the bridge piece and in turn affects or conditions the vibrational behavior of the strings themselves. The modification of the vibrational behavior of each individual string is enabled as the bridge piece 14 and tapered sound diaphragm 23 each furnish variable acoustical or mechanical reaction to the vibration of the strings. As will be described more fully herein, the degree to which the bridge and dynamic tone engendering structures are set into motion by the strings may be varied by adjustable parameters or elements within the bridge piece 14 and tapered sound diaphragm 23.

Bridge piece 14 may be constructed of hardwoods such as maple. Other materials may be substituted which display strength, mass density and acoustical energy transmission characteristics resembling those occurring in hardwoods such as maple. Special architecture of the bridge piece enables selective attenuation and filtering of acoustical energy which is transmitted from the strings through the bridge to optimized acoustical summing nodes 63, 64, 65, 66, 67, see FIGS. 12*a* and 13.

Figure 8:
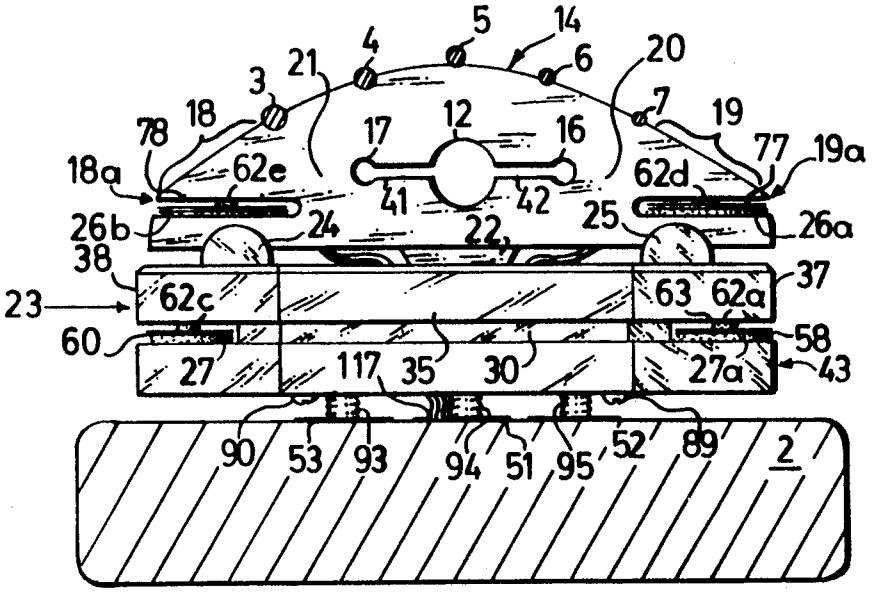
FIG. 8 is an end view of the present invention taken along lines A—A of FIG. 6.
Figure 13:
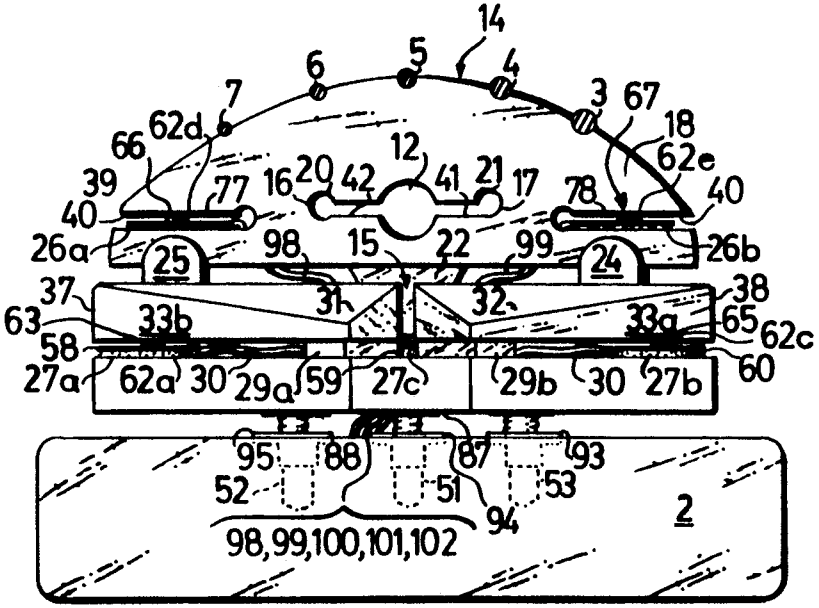
FIG. 13 is a top end view of the dynamic tone engendering means taken on lines D—D of FIG. 6.
Figure 12A:
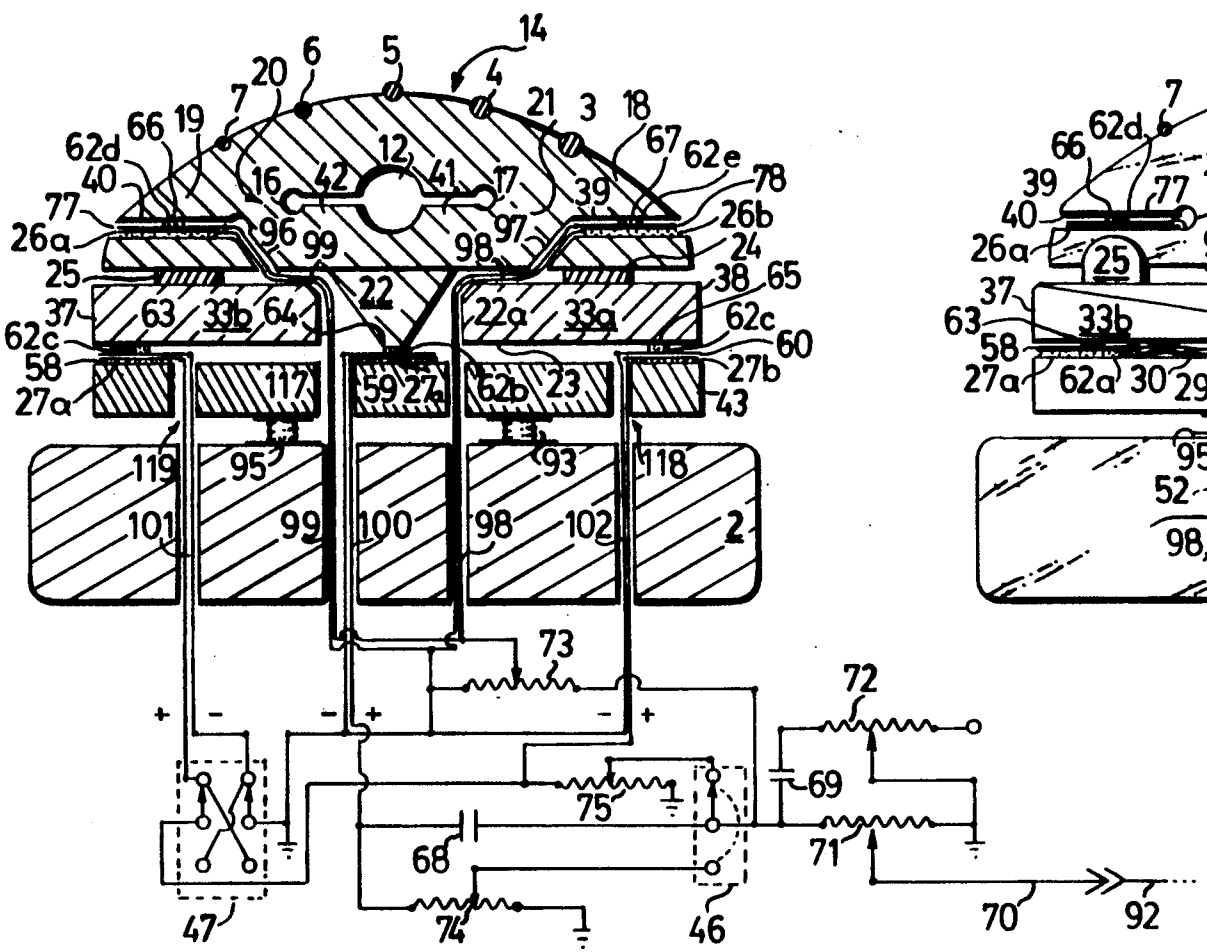
FIG. 12*a* is a combined cross sectional and electrical schematic view of the dynamic tone engendering means taken along lines C—C and along line 115 of FIG. 6.

Referring to FIG. 8, bridge piece 14 is in the nature of a wooden plate which may include through-holes 16 and 17 and space forming cuts 41, 42, see FIGS. 12*a* and 13. Bridge piece 14 is substantially smaller than traditional acoustical instrument bridges and only requires approximately one tenth of the material for its construction in the instance of a bass violin. Thus, bridge piece 14 has a low mass which assures transmission of the full range of audio frequencies, including the high upper partial frequencies which are transmitted from the strings to acoustical summing nodes 66, and 67 as in FIGS. 12*a* and 13.

The mechanical or acoustical impedance of the bridge piece 14 is decreased as its flexibility and compliance are increased by the through holes 16 and 17 and in conjunction with space forming cuts 41, 42. Unwanted resonances are substantially eliminated by the low mass and complex geometry of the bridge piece 14. As will be explained in greater detail below, bridge piece 14 forms several acoustically interactive portions.

In FIG. 8, depending segments 18 and 19 of bridge piece function as acoustical loads in the nature of asymmetrical inertial masses within which acoustical energy may be converted to motion and thus dissipated.

The bridge piece 14 itself has an overall physical asymmetry which prevents energy storage and acoustic wave propagation, such that unwanted resonances and reverberations are substantially eliminated.

Acoustic Energy Conduits

Remaining with FIG. 8, the cutout portions 12, 16 and 17 cooperate with slots 18*a* and 19*a* to form acoustic energy conduits 20 and 21. All acoustic energy emanating from the strings must pass through acoustic energy conduits 20 and 21. The acoustic energy is then transmitted to summing member 22. The amount of acoustical energy so transmitted by each string to summing member 22 may be adjusted by selectively altering the geometric parameters of the acoustic energy conduits 20 and 21, as well as the distance of the acoustic energy conduits 20 and 21 to the strings. In this way, the acoustical outputs of each of the strings may be balanced with respect to one another.

Figure 17:
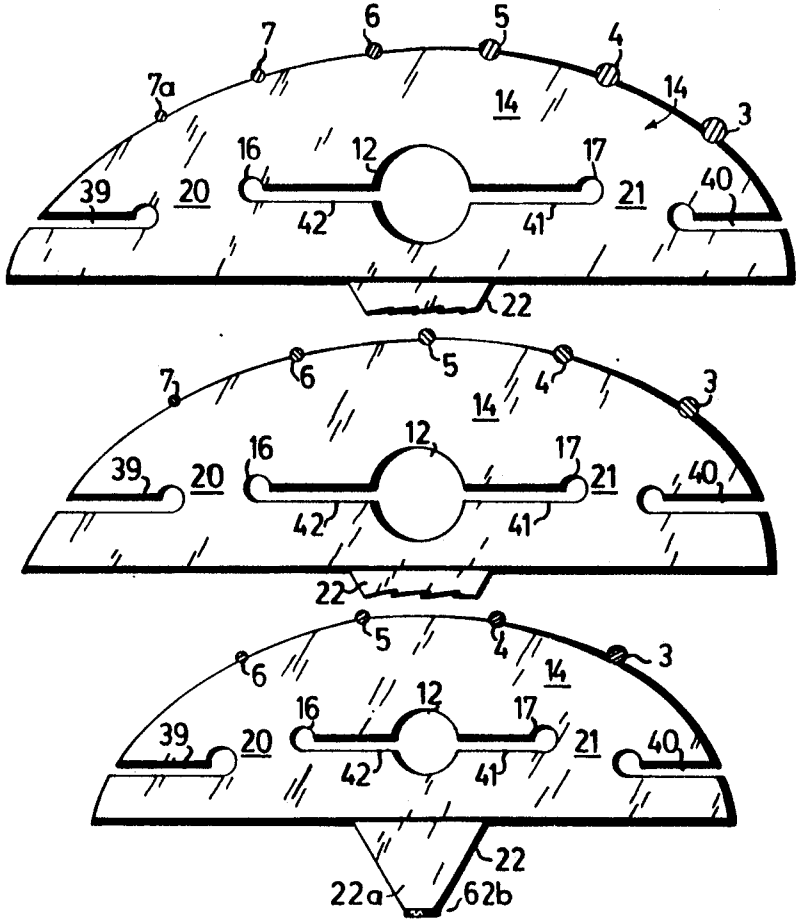
FIG. 17 illustrates bridge structure 14 with fixed acoustic energy conduits and architecture suited for six, five and four string musical instruments.

In another embodiment of the present invention, the energy conduits 20 and 21 may be constructed as separate slidable structures 103 and 104, as illustrated in FIGS. 14, 15, 18 and 19. Alternately, their positions may be preselected and fixed as illustrated in FIG. 17 for optimization of a specific string instrument to which the present invention is applied.

Highest Pitched String

As shown in FIG. 8, string 7 is tuned to the highest musical pitch among the strings 3, 4, 5, 6 and 7 and thus produces acoustical oscillations at higher frequencies than those produced by the lower pitched strings. Experimentation has shown that this string requires special conditions to assure balanced amplitude and playing response with respect to the other strings 3, 4, 5 and 6. Accordingly, acoustic energy conduit 20 has been situated below and directly under the highest pitched string 7, thus forming a shorter acoustical wave transmission pathway to tapered sound diaphragm 23. This shorter acoustical wave transmission path is required for effective transmission of the range of frequencies produced by string 7 to summing member 22.

Summing Member Extension

Figure 7A:
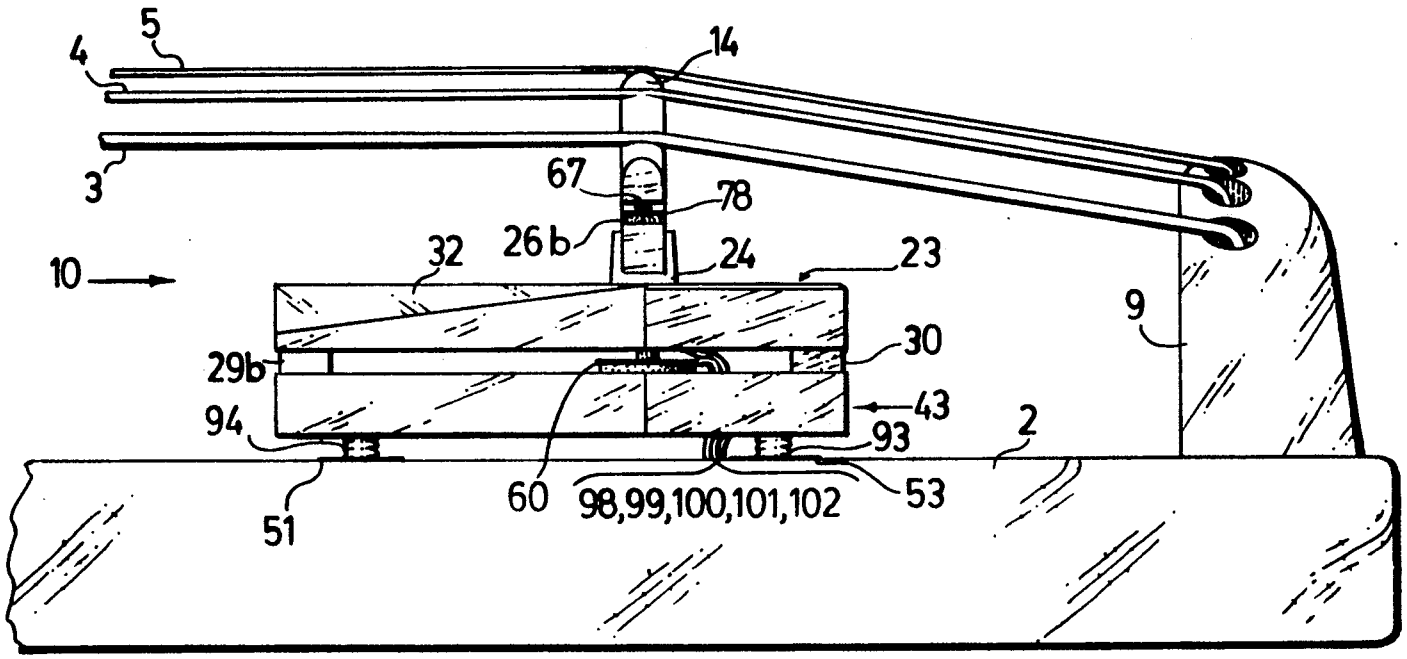
FIG. 7*a* illustrates the dynamic tone engendering means 10 of FIG. 6 as viewed from the side.
Figure 7B:
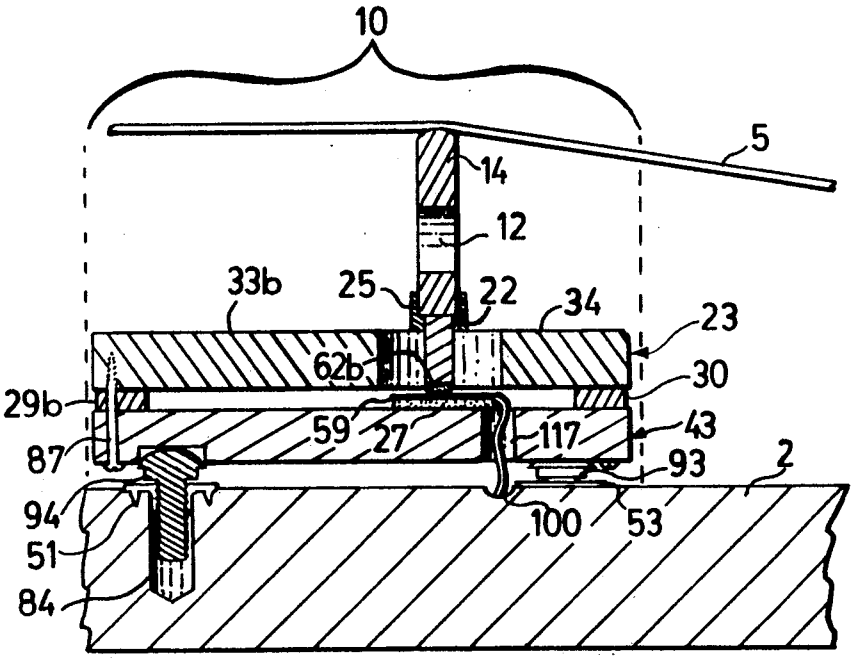
FIG. 7*b* is a cross sectional side view of the dynamic tone engendering means taken along lines B—B along center line 76 in FIGS. 5 and 6.

Referring to FIGS. 7*b* and 12*a*, summing member 22 includes vertical summing member extension 22*a*. Summing member extension 22*a* enables increased leverage of the outside strings 3 and 7 upon center piezo element 59, see FIG. 12*a*. Further, summing member extension 22*a* effectively provides increased leverage for displacement of piezo element 59 by a magnitude which otherwise would only be possible using bridge structures which are a minimum of one inch taller than bridge piece 14 in the case of a string bass. As can be seen from FIG. 12*a*, summing member extension 22*a* is generally triangular in shape with one corner serving as summing node 64. As can be seen from FIG. 7*b*, summing member extension 22*a* has a thickness which is slightly less than the thickness of bridge piece 14, and is an extension thereof. Thus, the overall mass of bridge piece 14 is kept to a minimum while its physical bulk is reduced for efficient acoustical vibration transmission.

Experimentation has shown that string 6 is in a frequency range and physical position with regard to the other strings which typically allows it an advantage in acoustically exciting piezo elements 60 and 59. Thus its amplitude and tonal characteristics should be conditioned to match the other strings. This is accomplished by selectively positioning treble-side through-hole 16 and space forming cut 42 well beneath the string 6. In this way the damping factor upon string 6 is increased and there in an increase in the amount of media through which acoustical energy produced by string 6 must travel to reach summing node 64, via summing extension 22*a*, FIG. 7*b*. In this way, string 6 can be brought into balance with strings 3, 4, 5 and 7, while string 7 is furnished with an improved pathway for the high frequencies particular to this string.

Interaction by Tapered Sound Diaphragm

Additional acoustical adjustments for the various strings are possible. Among these acoustical adjustments is the variable attenuation of thumps and subsonic energy which can result from percussive plucking of the lowest tuned strings 3 and 4. This adjustment may be accomplished by moving bass-side slidable bridge footing 24 toward the center of the bridge piece 14. See FIG. 8. By doing so, the bridge piece 14 may be positioned upon a stiffer portion of the tapered sound diaphragm 23, thus providing decreased reaction of the bridge 14 and sound diaphragm 23 to the lowest pitched strings 3 and 4, and substantially eliminating undesirable thumps and subsonic energy induced by pizzicato playing techniques. Should a more percussive quality be desired, slidable bridge footing 24 can be moved outward toward the unsupported leaf 38 of the tapered sound diaphragm 23. Unsupported leaves 37 and 38 are more clearly illustrated in FIG. 11*b*.

Further adjustments of the compliance of sound diaphragm 23 are achieved by selective positioning of front adjustable support blocks 29*a* and 29*b*. See FIGS. 11*a* and 11*b*. By bringing front adjustable support block 29*b* closer to unsupported leaf 37 of the tapered sound diaphragm 23, the resonance of tapered portion 33*a* of the sound diaphragm 23 is decreased in amplitude as well as raised in frequency. Further description of these and other adjustments is provided herein below.

Through the various adjustments provided by the present invention, sonic emulation of a wide scope of traditional acoustic string instruments is possible.

Number of Strings

It is to be understood that various numbers of strings may be used with the present invention. Typical string sets of four, five and six strings, as well as string sets comprising lesser or greater numbers of strings may be accommodated and compensated for by minor repositioning of the slidable bridge footing 24 and 25, slidable acoustic energy conduits 103 and 104, and/or slight geometric alterations of the cutout portions forming fixed acoustical conduits 21 and 22. See FIG. 8.

Figure 14:
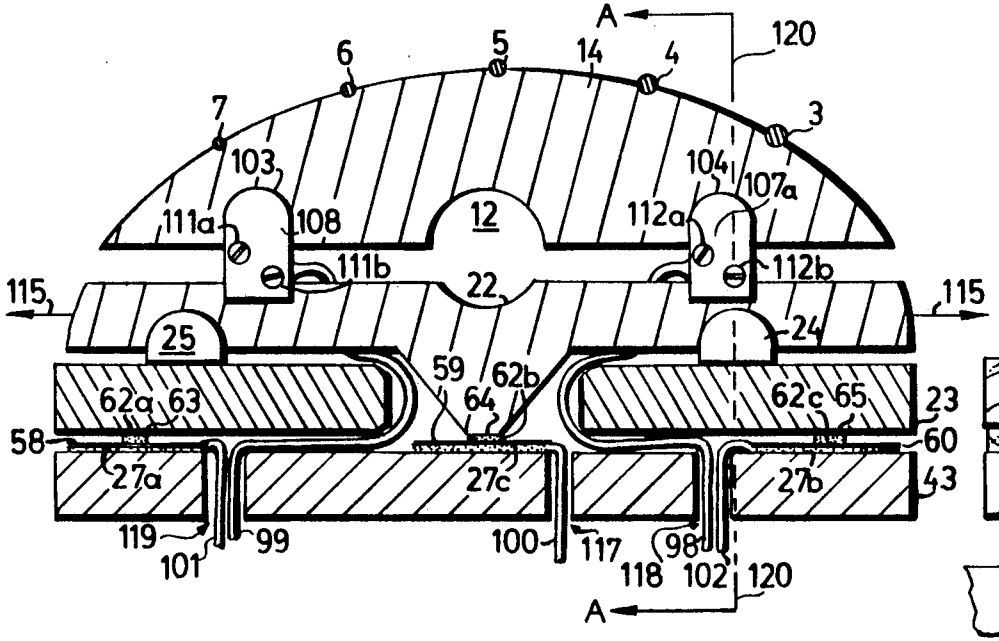
FIG. 14 shows a cross-sectional view of an embodiment of the dynamic tone engendering means incorporating slidable sound conduits 103 and 104.

FIGS. 17(*a*), (*b*) and (*c*) illustrate typical architectures for bridge piece 14 as optimized for string sets of four, five and six strings, however, when the present invention is constructed with slidable acoustic energy conduits 103 and 104, see FIG. 14, string sets of any number may be accommodated by adjusting the slidable acoustic energy conduits 103 and 104 along the same bridge piece 14.

Bridge Architecture for Guitar Family

FIGS. 18, 19, 20 and 21 show the dynamic tone engendering structure 10 of the present invention as applied to a guitar family string musical instrument, wherein the arch of the bridge is reduced to suit the requirements of the guitar family.

The mass of bridge piece 14 is thus distributed in a horizontal rather than a vertical form. The bridge piece material is kept to a similar mass in both guitar and violin applications of the present invention. The bridge piece in this embodiment is formed of two sections, crown section 14*c* and summing section 22*c*. Crown section 14*c* is coupled to summing section 22*c* through slidable acoustic energy conduits 103, 104*a* and 104*b*. As can be seen from the cross section of conduit 104*b* in FIG. 20, these slidable acoustic energy conduits include outer plates, for example outer plates 107*c* and 107*d*, which are captured by plate fasteners, for example 112*b*. Associated with each slidable acoustic energy conduit is a sensor structure which uses piezo elements, e.g. 27*c*, 59 and 62*b*.

Figure 16:
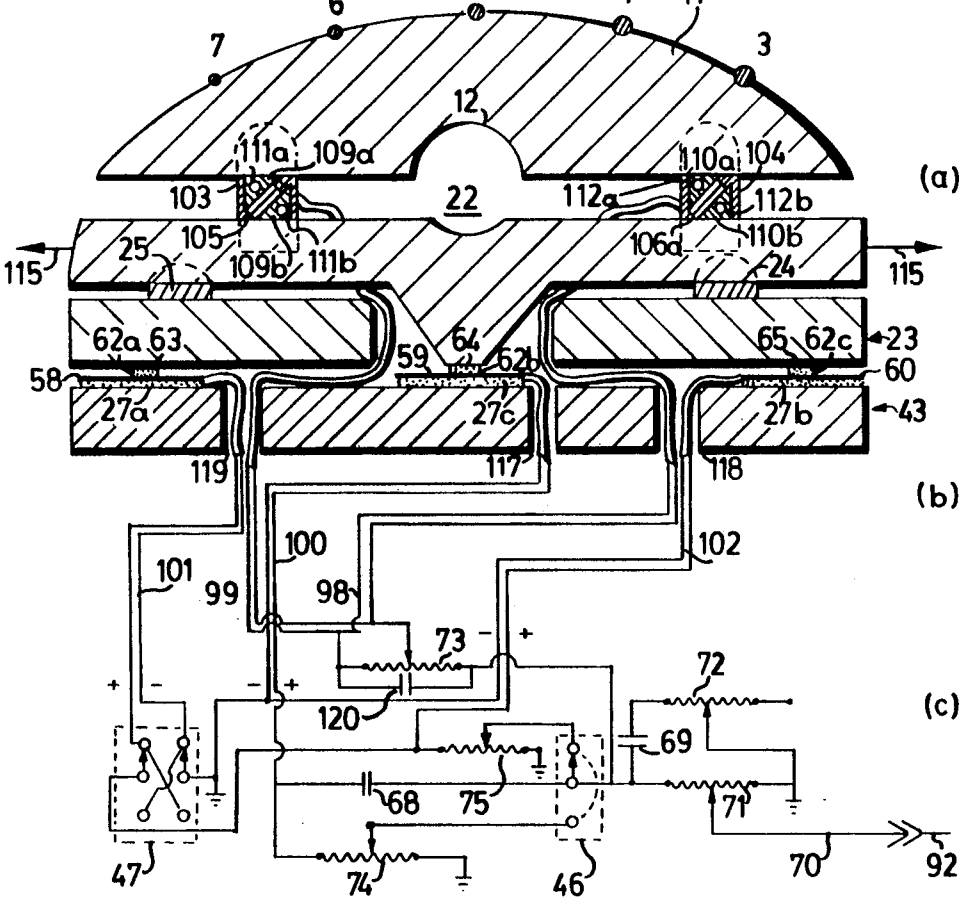
FIG. 16 is a combined electrical schematic diagram and cross sectional view of the dynamic tone engendering means taken along lined A—A of FIG. 15 including slidable acoustic energy conduits 103 and 104.
Figure 19:
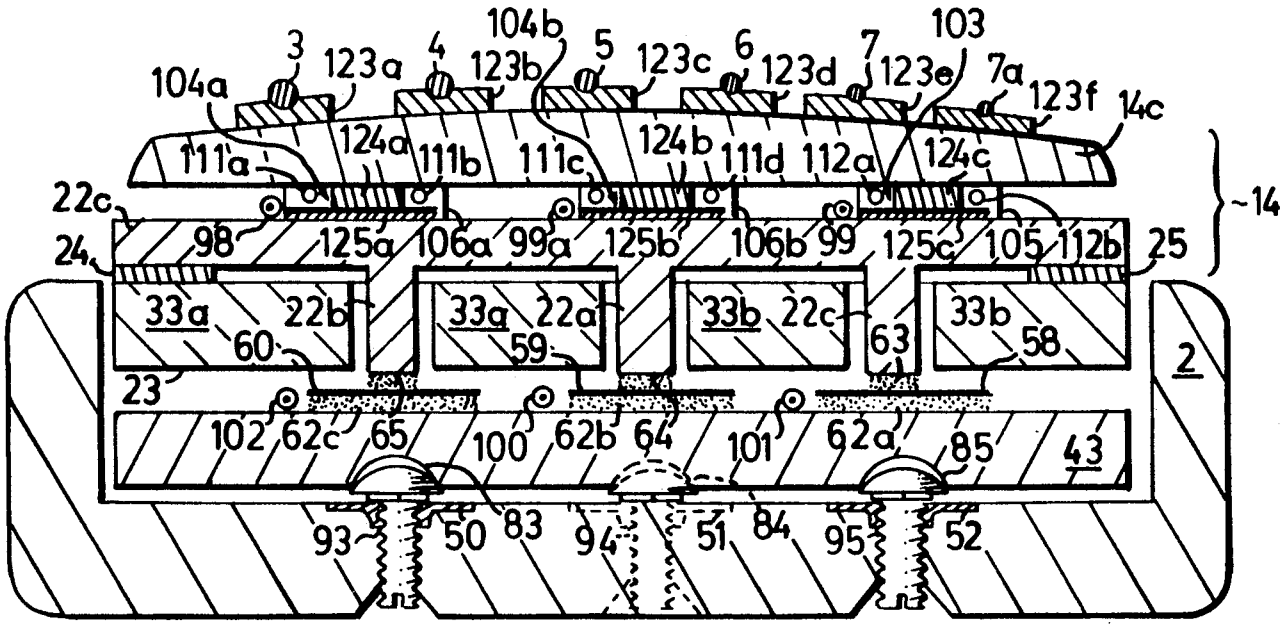
FIG. 19 illustrates a cross sectional view of a guitar family string instrument according to the present invention taken along lines A—A in FIG. 8.

Experimentation has shown that differences in transmission of vibration through the low profile arch of the guitar type bridge are compensated for by the inclusion of a piezo element 106*b*, as shown in FIG. 19, in addition to piezo elements 106*a* and 105 which are used in non-guitar embodiments, see FIG. 16. This additional element improves the response of the center strings 5 and 6 in the guitar embodiment.

Referring to FIG. 19, in addition to summing extension 22*a*, summing member extensions 22*b* and 22*c* may be included in both guitar and violin string instruments according to the present invention. These summing member extensions 22*b* and 22*c* are positioned to interact with piezo elements 60 and 58 respectively. Piezo elements 60 and 58 are supported on base table 43. While summing members 22*b* and 22*c* are not required for satisfactory operation of the present invention, their inclusion improves the emulation by the present invention of tonal characteristics of a string musical instrument constructed with a braced soundboard such as is found in many traditional guitars.

This emulation of the traditional braced soundboard is a product of decreased resonance and reverberation components in the vibrations detected at summing nodes 63 and 65, at the ends of summing member extensions 22*b* and 22*c*. Decreased resonance and reverberation are assured by simplified acoustic wave paths from the strings, through the bridge piece components, to the summing member extensions 22*a*, 22*b* and 22*c*. Sound diaphragm through-holes 28, 28*a* and 28*b*, FIG. 21, allow summing member extensions 22*a*, 22*b* and 22*c* to pass through the sound diaphragm.

Figure 18:
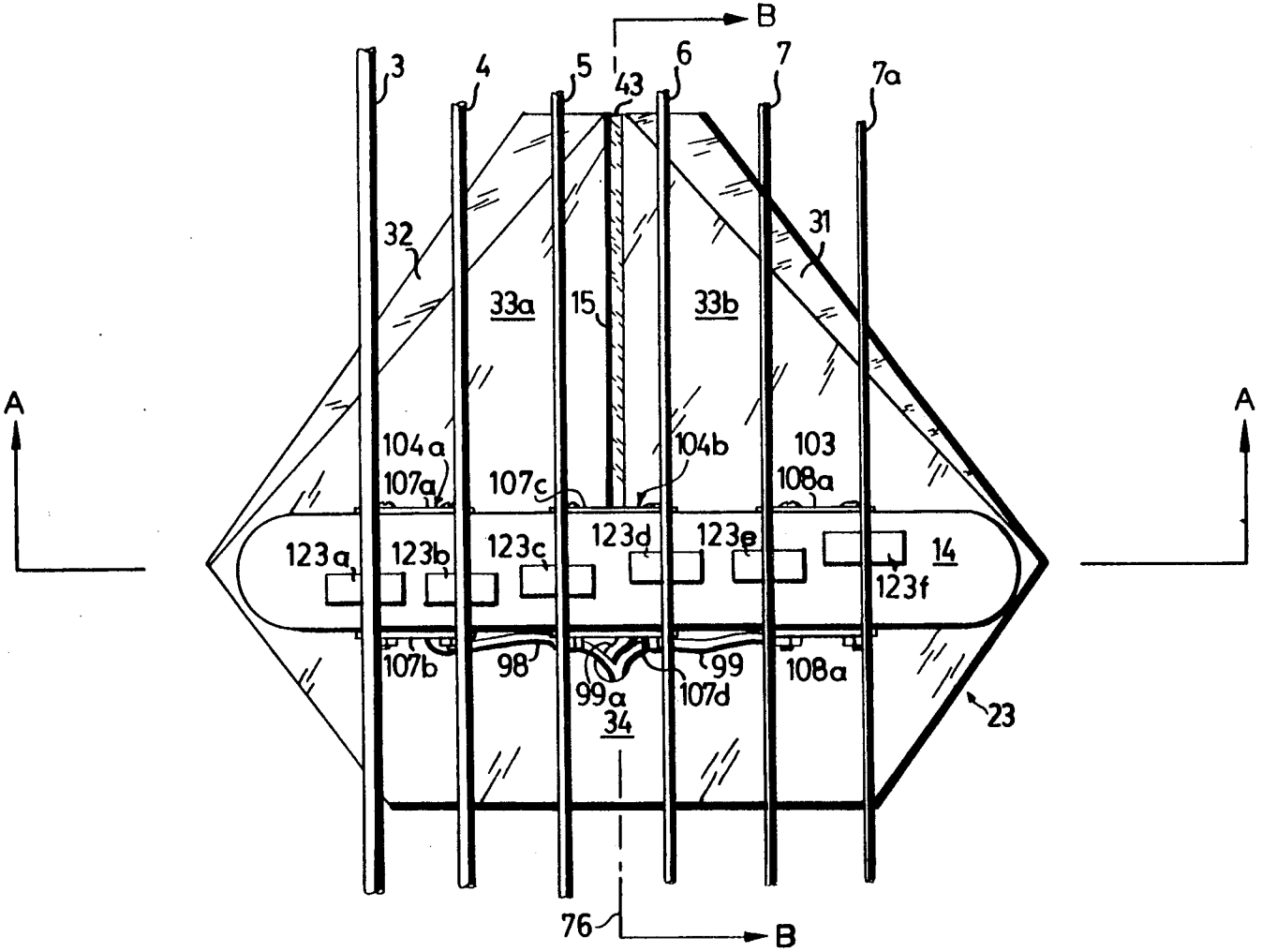
FIG. 18 is a top plan view of dynamic tone engendering means 10 as applied to a guitar family string musical instrument.

Summing member extensions 22*a*, 22*b* and 22*c* may be constructed using hardwood dowels whose diameters are selected to be less than the diameters of sound diaphragm through holes 28, 28*a* and 28*b*. As shown in FIG. 18, in this way an air space is formed around the circumference of the summing member extensions 22*a*, 22*b* and 22*c* as they pass through the sound diaphragm 43, thus acoustically isolating the summing member extensions from the sound diaphragm at through holes 28, 28*a* and 28*b*.

When the present invention is applied to instruments of the guitar family, independent string saddles 123*a*, 123*b*, 123*c*, 123*d*, 123*e* and 123*f*, as in FIG. 19 may be included for well known intonation adjustments such as are common on fretted string musical instruments. Sound conducting piezo element interface slugs 124*a*, 124*b* and 124*c*, as well as piezo element foundation pads 125*a*, 125*b* and 125*c* may be constructed of plastic materials such as Kydex® or other materials possessing similar mass densities and elastic qualities.

Tapered Sound Diaphragm—Guitar and Generally

Referring now to FIG. 19, the bridge piece 14 is under the pressure of the tensioned strings 3, 4, 5, 6, 7 and 7*a* and is held in pressure contact with tapered sound diaphragm 23, thus bridge piece 14 is in mechanical contact and in acoustical communication with tapered sound diaphragm 23. The communication of acoustical energy from the bridge piece to the tapered sound diaphragm is via slidable bridge footings 24 and 25. These slidable bridge footings bear upon unsupported leaves 37 and 38 of tapered sound diaphragm 23. See FIGS. 11*b* and 21.

Figure 21:
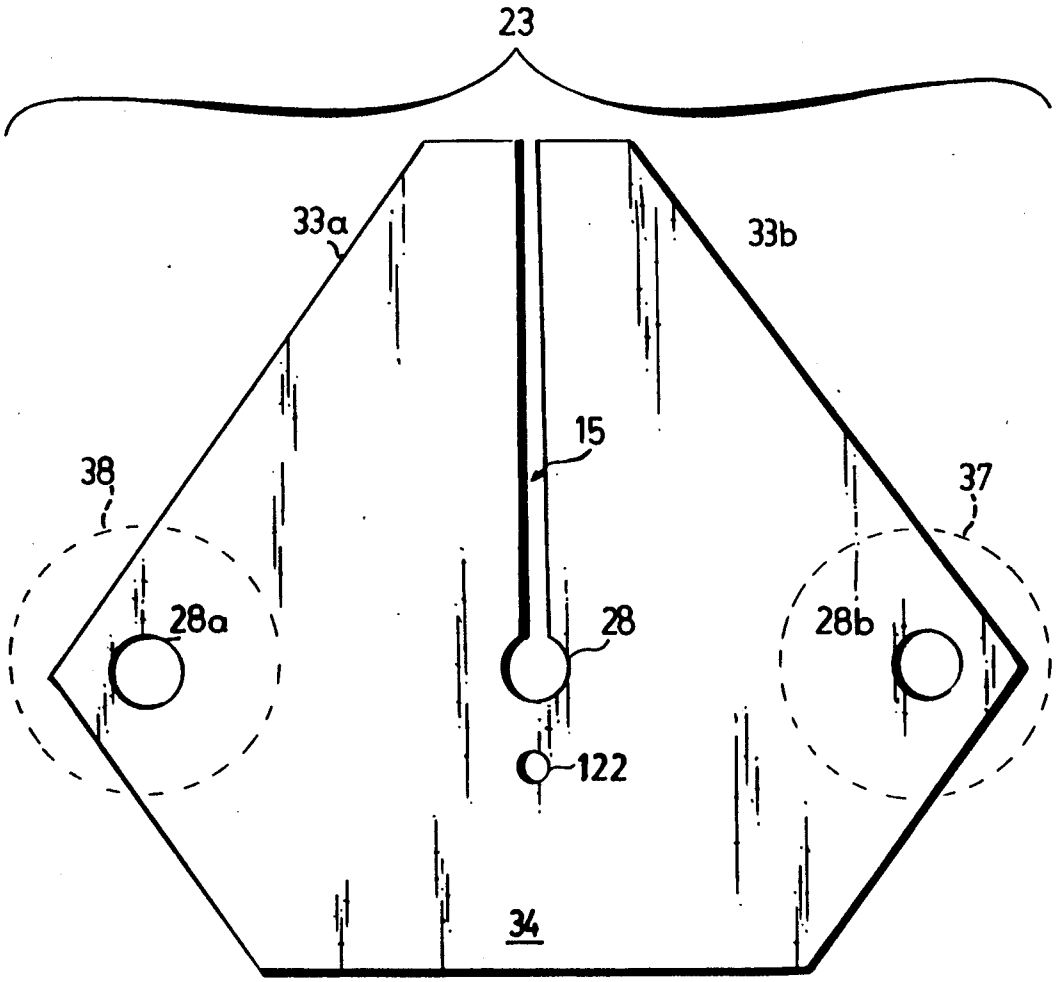
FIG. 21 is a top plan view of the tapered sound diaphragm 23.

As can be seen in FIG. 21, tapered sound diaphragm 23 can be substantially diamond shaped with circular perforation 28 included in its approximate center and acoustic energy boundary slot 15 extending therefrom. Tapered sound diaphragm 23 can further include additional perforations 28*a* and 28*b* as discussed earlier, herein.

Tapered sound diaphragm 23 is preferably made of low mass density wood such as aged violin grade spruce; however pine or other low mass density materials may be substituted, provided they display a directional elastic modulus as is apparent in spruce and pine. Best results are achieved when the mass density of the tapered sound diaphragm is considerably lower than the mass density of the bridge piece 14. In this way, the low mass density material is able to rapidly accelerate in response to acoustical energy and resonant reverberations are greatly reduced due to the inability of the lower mass to store acoustical energy.

Tapered sound diaphragm 23 is preferably between $\frac{3}{8}$" and $\frac{5}{8}$" in thickness, approximately four times thicker than typical traditional soundboards. The tapered sound diaphragm can be approximately 1/30th the surface size of a traditional soundboard and typically will be less than $\frac{1}{8}$th the length of the string of the instrument to which it is applied. Due to the small surface area and increased thickness of the tapered diaphragm 23, acoustic loudspeaker feedback is minimized. Further, the amount of precious tone wood required for construction of the present invention is less than 1/50th of that required for a traditional carved instrument of like kind.

Figures 9, 10, 11A, 11B:
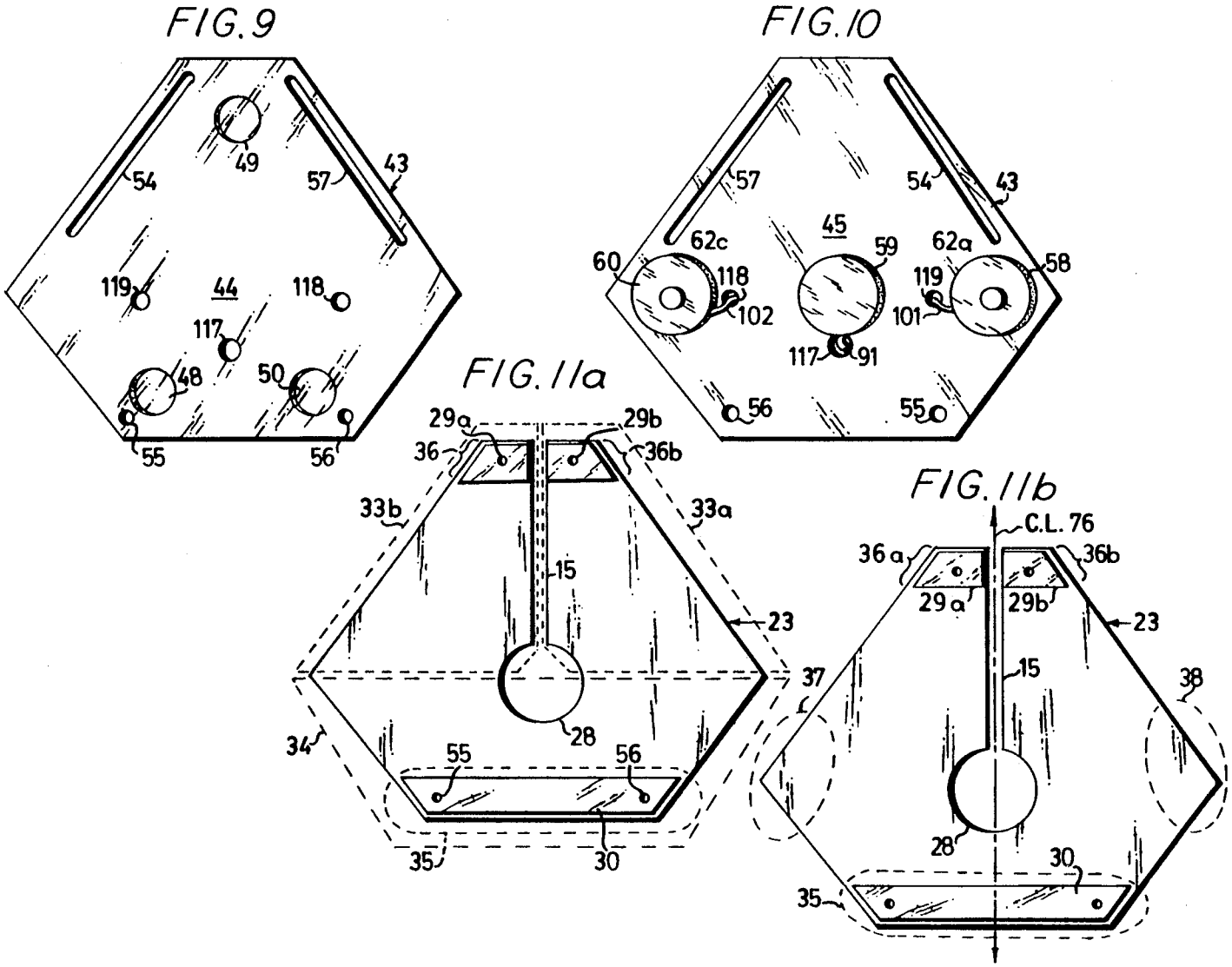
FIG. 9 shows details of the underside of the massive base table 43.
FIG. 10 is a top view of the massive base table 43 with piezo elements 58, 59 and 60 mounted thereon.
FIG. 11*a* illustrates the underside of the tapered sound diaphragm with three support blocks 29*a*, 29*b* and 30 mounted thereupon.
FIG. 11*b* is a bottom view of the tapered sound diaphragm and illustrates supported and unsupported portions of the tapered sound diaphragm of the present invention.

The substantially diamond shape of tapered sound diaphragm 23 enables formation of three tapered portions 33*a*, 33*b* and 34. As shown in FIG. 11*a*, the tapered portions 33*a* and 33*b*, on the fingerboard side of the bridge piece 14, and tapered portion 34, on the tailpiece side of the bridge piece 14, are of unequal length and asymmetrical geometry such that any standing wave effects which may exist within each of the tapered portions will be minimized and any residual resonances may be tuned to differing frequencies.

For example, tapered portion 34 has a trapezoidal shape, while tapered portions 33*a* and 33*b* are somewhat more triangular in shape. From another point of view, tapered portions 33*a* and 33*b* both have two parallel edges, neither of which is the longest edge; while tapered portion 34 has two parallel edges, one of which is the longest edge. The distance between the parallel edges of tapered portions 33*a* and 33*b* may be slightly less than twice the distance between the parallel edges of tapered portion 34.

Figure 6:
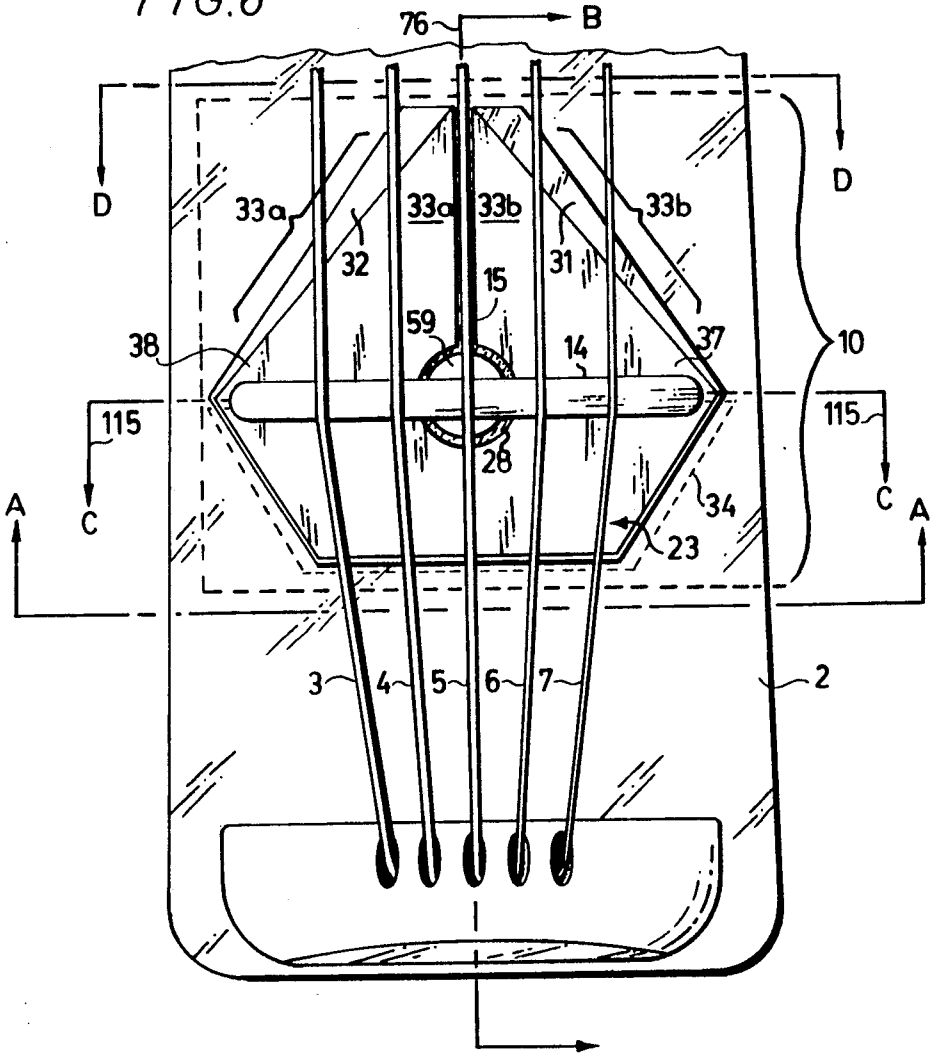
FIG. 6 is a top plan view of a cutaway section of FIG. 1*a* showing the dynamic tone engendering means 10 and tailpiece 9.

As can be seen in FIGS. 5 and 6, facets 31 and 32 are beveled into the edges of tapered portions 33*a* and 33*b*. Facets 31 and 32 provide asymmetrical boundary conditions for acoustical waves traveling within tapered portions 33*a* and 33*b*. In the absence of these bevels, acoustical waves will tend to reflect off the side walls of tapered portions 33*a* and 33*b*. The beveling changes the direction of the acoustical wave reflections off the side boundaries, resulting in minimal acoustic wave propagation and standing wave effects within the longer tapered portions 33*a* and 33*b*.

As can be seen in FIGS. 1, 5, 11*a*, and 11*b*, tapered sound diaphragm 23 provides three supported extremities 35, 36*a* and 36*b* and the two unsupported leaves 37 and 38. The supported extremities rest upon rear support block 30 and front adjustable support blocks 29*a* and 29*b*. Front adjustable support blocks 29*a* and 29*b* allow the degree of compliance of tapered portions 33*a* and 33*b* to be individually adjusted, thus any residual resonances may be tuned to differing frequencies.

Unsupported leaves 37 and 38 shown in FIGS. 5, 6, 8, 11*b*, 12 and 13 are shaped to provide increasing flexibility outward from center line 76. Slidable bridge footings 24 and 25, e.g. see FIG. 8, permit user adjustment of the point of contact between the bridge piece 14 and the tapered sound diaphragm 23 at all points upon the unsupported leaves 37 and 38. By placing the slidable bridge footing near the outer edge of the unsupported leaves 37 and 38 the acoustical energy produced by the strings and transmitted through the bridge piece will result in greater low frequency excitation of the sound diaphragm 23. Conversely, placement of the slidable bridge footing closer to center line 76 will conserve acoustical energy and result in decreased excitation of the sound diaphragm 23. These adjustments enable the user to trim or calibrate the reaction of the sound diaphragm 23 to suit the particular requirements of the user.

Figure 15:
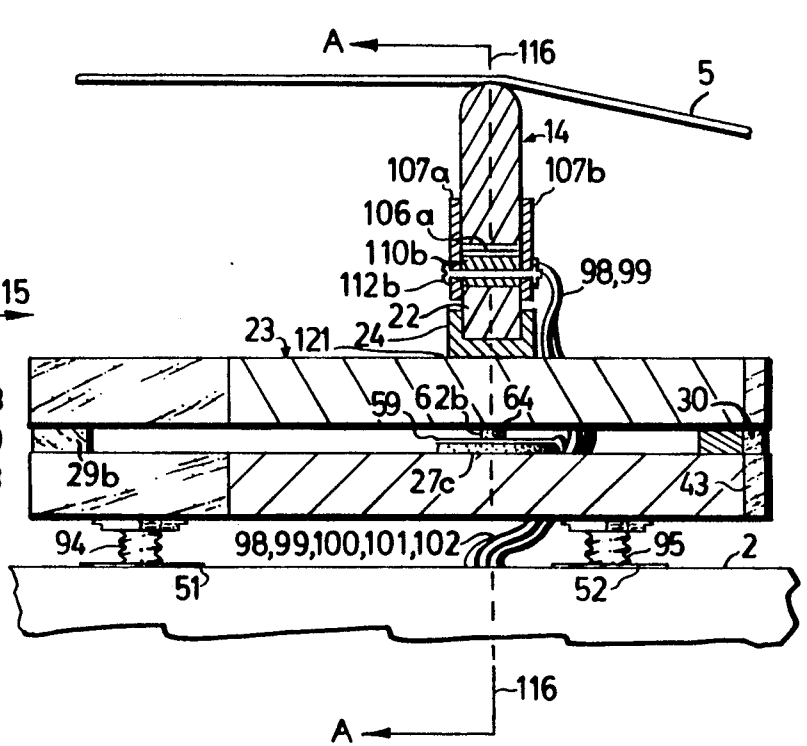
FIG. 15 is a cross sectional view of the dynamic tone engendering means with slidable acoustic energy conduits taken along lines A—A of FIG. 14.

As can be seen from FIGS. 14 and 15, for example, slidable footings 24 and 25 have a "u" shape, with the bottom of bridge piece 14 being captured between the vertical sections of the footings and resting on the horizontal section of the footings. These footings are preferably made of hardwoods or plastics, such as polycarbonates. It is to be understood that slidable footings 24 and 25 can be used in combination with piezoelectric materials to transduce acoustic energy imparted to them by bridge piece 14 and tapered sound diaphragm 23.

In traditional violin family string instruments, such asymmetrical tuning of resonances is provided by way of tuning front and back plates one half step apart as well as providing a sound post which stiffens the soundboard under the "treble foot" of the bridge, while the "bass foot" of the bridge bears upon a more free floating structure. Therefore, in traditional violin family string instruments, the treble frequencies encounter an optimized acoustical impedance and the bass frequencies, which require greater physical displacement for effective coupling and transmission, encounter a commensurate matched acoustical impedance. In the finest acoustical string instruments, the efficiency of vibration transmission from the strings to excitable acoustic energy radiating surfaces is optimized for the full range of frequencies to be produced.

The present invention enables the differing amplitudes and frequencies of acoustical energy produced by each string to encounter acoustical impedances selected for balanced transmission to piezo transducers 58, 59, 60, and 77 and 78, or 105 and 106*a*. In other words, the acoustic energy reaching the piezo transducers 58, 59, 60, and 77 and 78, or 105 and 106*a* is optimally balanced, even though the acoustic energy produced by each may differ from string to string.

Further, in accordance with the present invention, the degree to which the different frequencies generated by the variously tuned strings are transmitted to piezo transducers 58, 59, 60, 77, 78, 105 and 106*a* may be adjusted, permitting replication of a wide assortment of sonic signatures and playing characteristics of various string musical instruments.

Damping Pad and Miniature Sound Post Embodiment

Although the sound diaphragm 23 and its long narrow tapered portions 33*a* and 33*b* may be adjusted and tuned to suit many musical requirements by repositioning adjustable support blocks 29*a* and 29*b*, additional adjustments for maximum versatility are provided. Referring to FIGS. 1*b*, 22, 23, 24, and 25, damping pad 124 and movable elastic soundpost 125 enable additional adjustments affecting the sound diaphragm's overhanging leaves 37 and 38.

Damping pad 124 may be constructed of rubber such as neoprene or Sorbothane ®, manufactured by Hamilton Kent Manufacturing Co. of Kent, Ohio. The latter is preferred when damping of any residual reverberant resonances of tapered portion 33*a* is to be achieved with minimal interference with the compliance of unsupported leaf 37. Sorbothane ® provides maximum acoustical energy absorption with minimal restriction of the movement of the unsupported leaf 37 (bass side). Thus resonances of the unsupported leaf 37 may be decreased, yet compliance and resonant frequency of the tapered portion 33*a* (bass side) are little affected.

Moveable elastic soundpost 125 may be constructed of cork wood or similar materials and may be mounted in pressure contact with the underside of unsupported leaf 38 (treble side) and bearing upon massive base table 43. In this way, the compliance of unsupported leaf 38 (treble side) is reduced or stiffened. Cork has been found to provide resilience emulative of wooden structures whose dimensions are much larger than those possible within the restricted geometry of the invention. Moveable elastic soundpost 125 is resetable for fine adjustments of the flexibility of narrow tapered portion 33*b* of the sound diaphragm 23.

In FIGS. 1*b*, 22, 24, 25*a* and 27, bridge piece 14 has been configured to include piezo transducer 126 which may be used for detection the acoustic energy of highest pitched string 7. Piezo transducer 126 may be placed between the two highest pitched strings 6 and 7 and extend into the material comprising bridge piece 14 at an angle relative to the face of the tapered sound diaphragm 23. The distance which piezo transducer 126 extends downward into bridge piece 14 may typically be determined by the requirement that the axis of the down bearing force exerted by the operatively associated string 7 intersect a portion of piezo transducer 126.

Piezo transducer 126 typically reaches downward into bridge piece 14 at an angle enabling vertical and horizontal vibration to deform the piezo material. For example, an angle of 60 degrees can be used. To assure realistic emulation of traditional sound quality and response from string 7, it is desirable to leave as much wood between piezo transducer 126 and string 7 as possible. In this way, the wood or other material constituting bridge piece 14 substantially filters unrealistic high frequency perturbations of string 7. This physical relationship between piezo transducer 126 and string 7 assures that the desirable acoustical energy produced by bowing and plucking highest pitched string 7 will mechanically deform piezo transducer 126. In this way, electrical signals analogous to the desired acoustical energy fluctuations produced by bowing or plucking highest pitched string 7 are generated.

Figure 32:
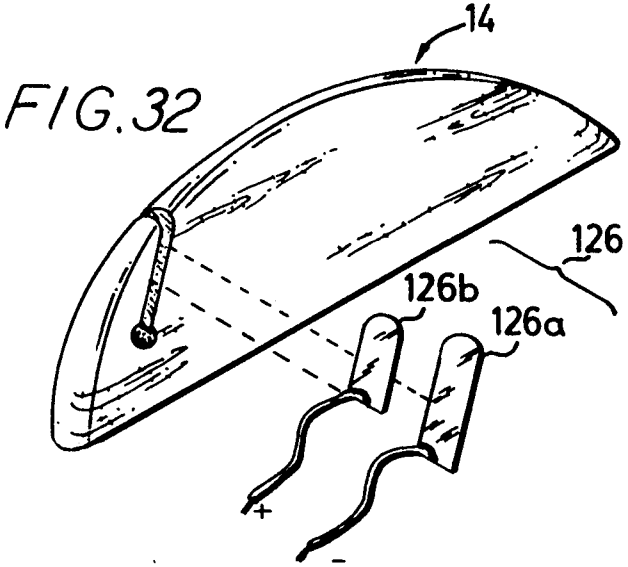
FIG. 32 is an exploded view of the piezo transducer structure 126 of FIG. 24.

Piezo transducer 126 may be constructed of bonded brass 126*a* and ceramic PZT5 material 126*b*. The thickness of the piezo ceramic material is preferably between 5 and 20 mils. See FIG. 32. Ceramic material with thickness under ten mils provides best results due to low mechanical impedance and low inertial mass. Fast response to and minimal interference with sonic accelerations of bridge piece 14 are achieved by reducing the inertial mass of the piezo ceramic material and brass substrate to the lowest possible quantum. The thickness of the brass substrate may be substantially similar to the thickness of the ceramic material. To minimize storage and reflection of the acoustical energy traveling within the bridge piece 14 minimal thickness and mass are preferred in the construction of piezo transducer 126, thus assuring minimal interference with the acoustical continuity of the bridge piece 14.

An added benefit of thin PZT5 ceramic resides in the low noise level resulting from lower electrical impedances yielded by thin piezo ceramic material. The brass substrate may be electrically connected to ground for providing an electrostatic shield further lowering spurious noise levels. It is important that piezo transducer 126 be tightly fitted into a slot formed within the bridge piece 14. An adhesive filler such as cyanoacrylate may be used to assure mechanical stability of piezo transducer 126 within bridge piece 14.

Figures 22, 23, 24:
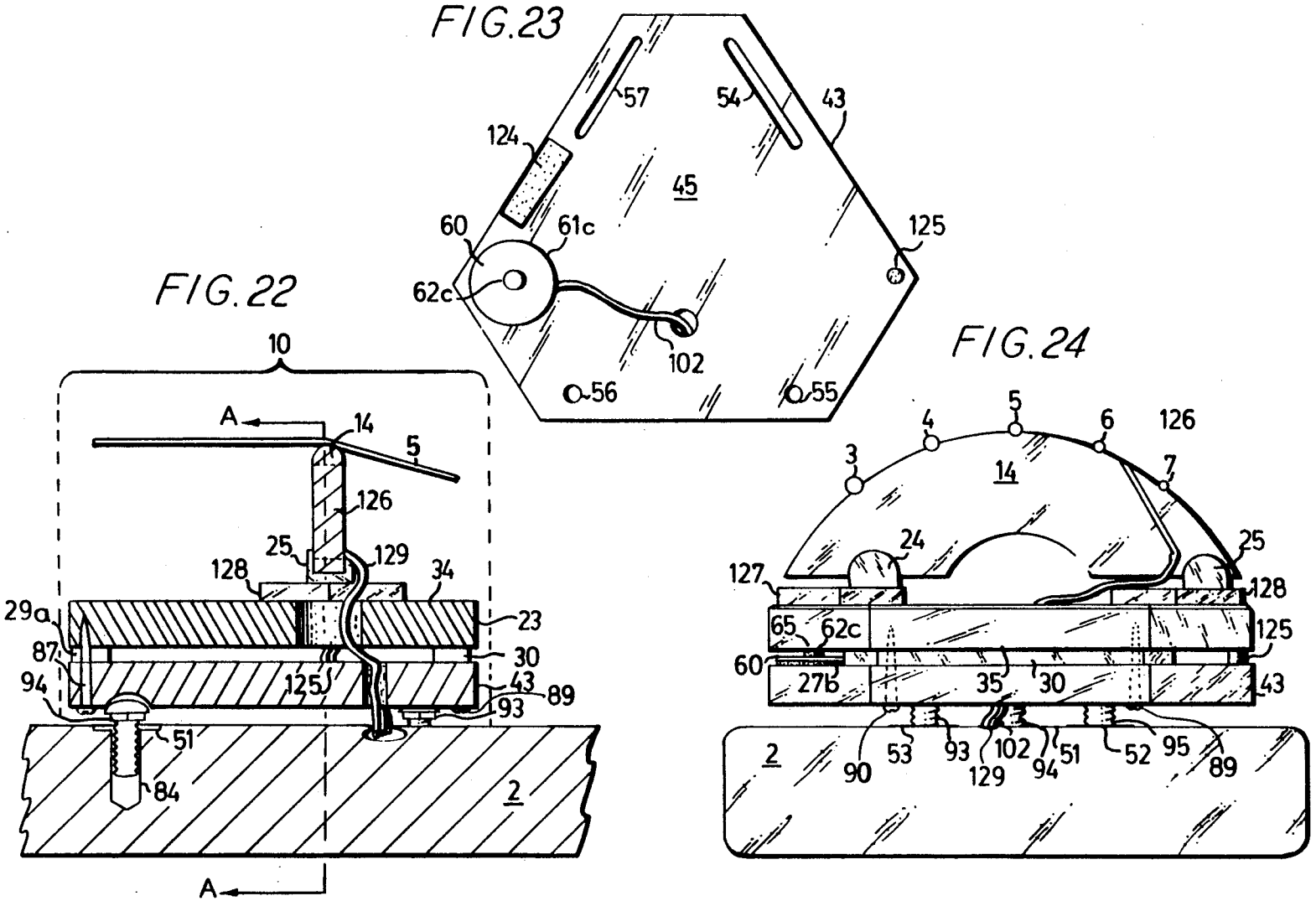
FIG. 22 is a sectional view of a further embodiment of the present invention illustrating the use of a moveable elastic sound post 125, a damping pad 124, and scuff pads 128 to further adjust the response of the sound diaphragm.
FIG. 23 is a plan view of the massive base table 43 of FIG. 22, illustrating the positioning of the moveable elastic sound post 125 and damping pad 124.
FIG. 24 is a rear view of the bridge structure of FIG. 22, illustrating the positioning of the moveable elastic sound post 125 and scuff pads 127 and 128.

In the embodiment shown in FIG. 24, the vibratory oscillations of string 7 are of interest. As discussed earlier herein, bowing produces string oscillations whose pressure wavefronts emanate in a plane horizontal to the axis of the strings. Plucked strings produce pressure wavefronts whose direction of propagation is largely vertical to the axis of the strings. The angled orientation of the piezo elements permits the sensing of both these types of directional forces.

When string sets of lesser or greater number than the five string set shown in FIGS. 1*b*, 24, 25*a*, 25*b*, 26 and 27 are to be applied to the present invention, piezo transducer 126 should be placed between the strings which are tuned to the highest frequency and should underlie the string of highest frequency. In FIGS. 1*b*, 22, 24, 25*a*, 25*b* and 27 bridge piece 14 is shown including piezo transducer 126.

Slidable bridge footings 24 and 25 bear upon scuff pads 127 and 128 which are preferably made of plastic such as Kydex ® or polycarbonates. Scuff pads 127 and 128 provide a durable surface upon which the bridge footings may be adjusted. As additional benefit, the large coplanar surface shared by the scuff pads 127 and 128 and the tapered sound diaphragm 23 assists in dampening residual reverberations which may occur in the tapered sound diaphragm 23. For optical results the total coplanar surface area may typically be between one-tenth and one-seventh of the surface area of the face of the tapered sound diaphragm 23.

Figure 25B:
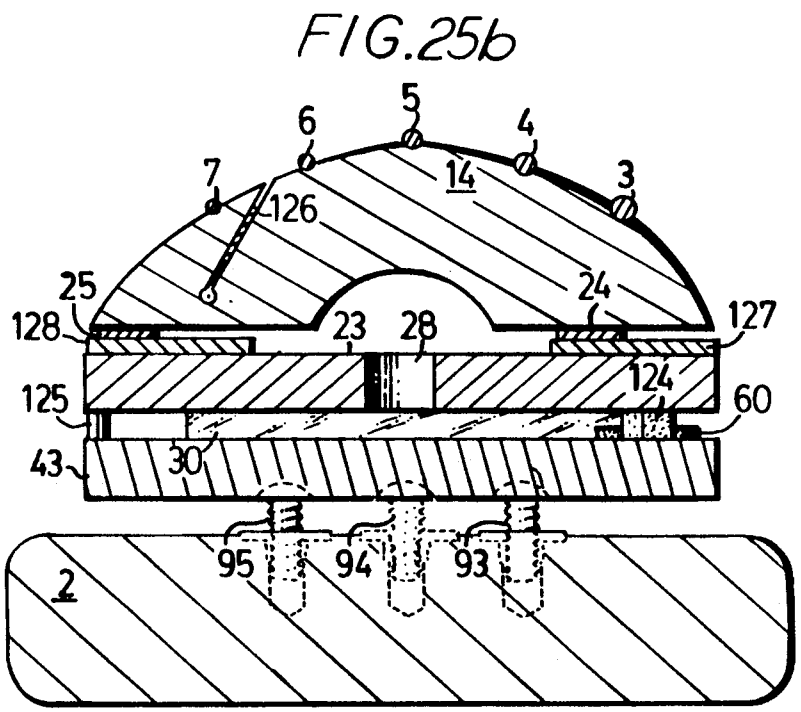
FIG. 25*b* is a sectional view of the bridge structure taken along lines A—A of FIG. 22, illustrating the positioning of moveable elastic sound post 125, scuff pads 127 and 128, and damping pad 124.
Figure 25A:
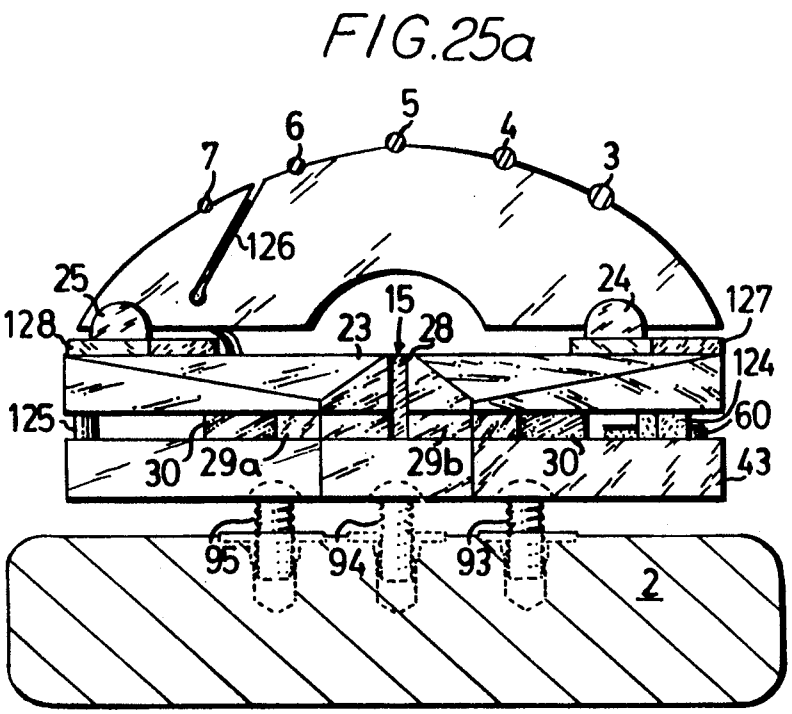
FIG. 25*a* is a front view of the bridge structure of FIG. 22, illustrating the positioning of moveable elastic sound post 125, scuff pads 127 and 128, and damping pad 124.
Figure 26:
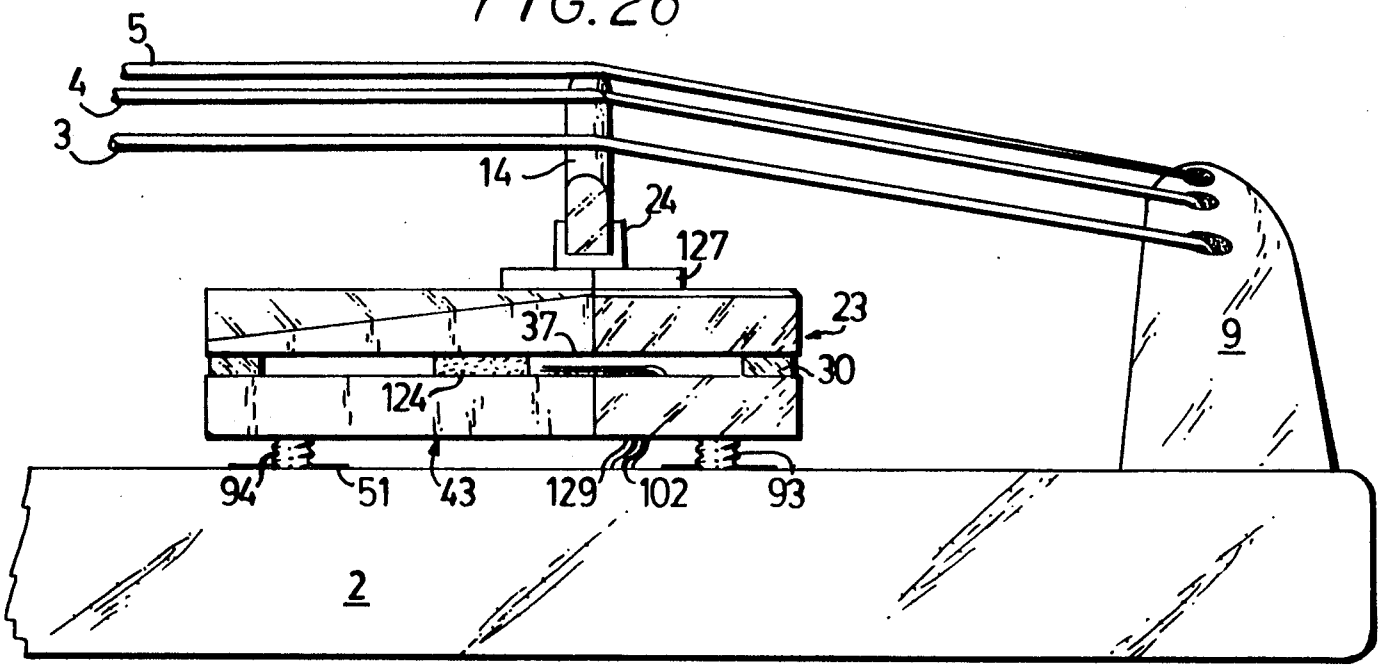
FIG. 26 is a side view of the bridge structure FIG. 22, illustrating the positioning of moveable elastic sound post 125, scuff pads 127 and 128 and damping pad 124.
Figure 27:
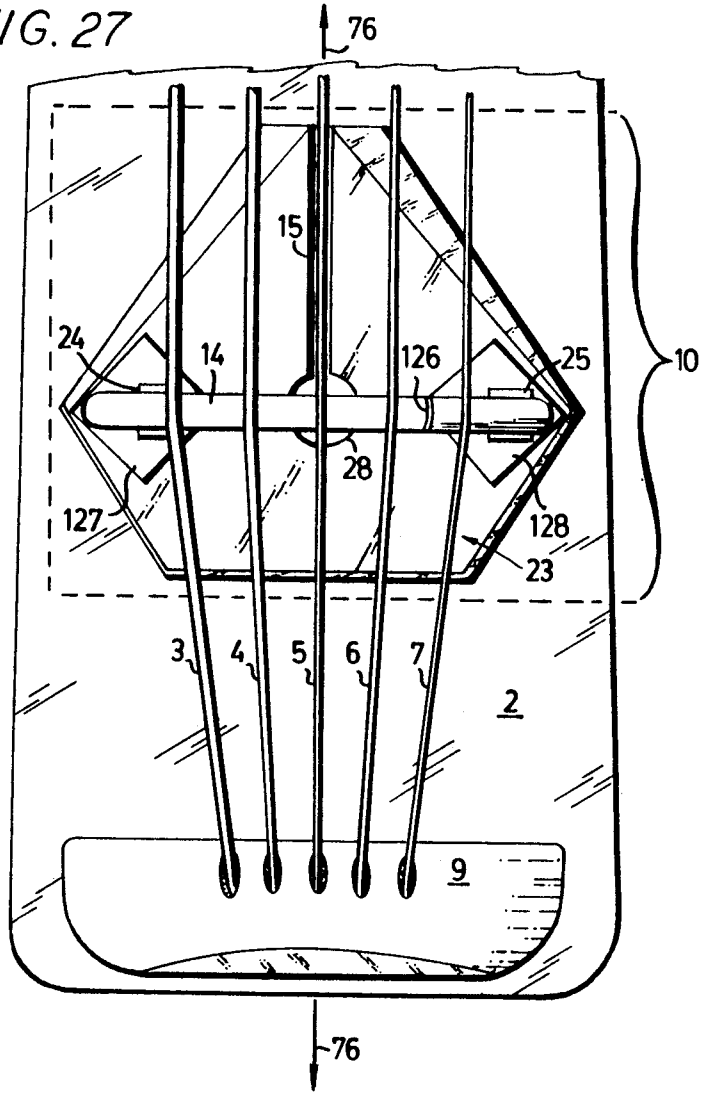
FIG. 27 is a plan view of the bridge structure of FIG. 22, illustrating the positioning of the scuff pads 127 and 128 beneath the slidable bridge footings 24 and 25.

As can be seen in FIGS. 25, 25*a* and 25*b*, the present invention is shown with piezo element 60 and piezo transducer 126. This combination of transducer elements in conjunction with miniature elastic sound post 125 and damping pad 124 enables this embodiment of the present invention to very closely emulate the dynamic and timbral response of master crafted violin family string instruments. The compensations for the amplitude and frequency characteristics of the highest pitched string 7 are accomplished by the proximity of piezo transducer 126 to highest pitched string 7. Additional adjustment of the outlet level of string 7 may be accomplished through electrical means such as variable resistor, not shown, which may be placed in the output signal path of piezo transducer 126.

It is to be noted that the embodiment of FIGS. 23–26 does not employ a perforated bridge piece or a summing extension, such as is employed in the embodiment of FIG. 12*a*. As such, slidable bridge footings 24 and 25 function as acoustic energy conduits which transmit acoustic energy from selected areas of bridge piece 14 to sound diaphragm 23. The positions selected for slidable bridge footings 24 and 25 to make contact with bridge piece 14 determine whether the acoustic energy from a particular string will be diminished or enhanced.

Base Table

As can be seen, for example, in FIG. 7*a*, 11*a*, and 13, tapered sound diaphragm 13 is in mechanical contact with massive base table 43 at its three supported extremities 35, 36*a* and 36*b* which bear upon the massive base table 43 via front adjustable support blocks 29*a* and 29*b*, and rear support block 30. Massive base table 43 can be constructed of materials exhibiting mass densities higher than those of the bridge piece 14 and the tapered sound diaphragm 23. Materials which are reasonably stiff yet display damping factors greater than those of the bridge piece and tapered sound diaphragm 23 are suitable. Suitable materials include birch wood, birch plywood or composite materials and laminates displaying the above qualities. While it is possible to use very high mass metals and composites, the additional cost and weight of such materials renders their use less desireable.

Massive base table 43 can be shaped in conformance with the perimeter of the tapered sound diaphragm, as this shape is anti-resonant due to its tapering geometry. See, for example, FIGS. 9 and 10. Massive base table 43 can be of a thickness between $\frac{5}{8}''$ and $\frac{3}{4}''$. See, for example, FIG. 7*a*. Massive base table 43 may also be constructed of two or more elements as in FIGS. 28 and 29 for increasing acoustical isolation from the environment. The separate sections of the base table 43 may be made of differing high mass materials separated by damping materials such as Sorbothane ® or soft neoprene.

Height adjustment of the entire dynamic tone engendering structure 10 relative to the face of the body 2 is provided by three round head height adjusting bolts 93, 94 and 95 which mate with three receiving holes 48, 49, and 50 on the under surface of massive base table 43. See, for example, FIG. 9. Receiving holes 48, 49 and 50 are preferably hemispherical for engaging the round heads of height adjusting bolts 93, 94 and 95. This height adjustment method has no adverse affect on the acoustically sensitive parameters of the dynamic tone engendering structure 10, as the location of round head height adjusting bolts 93, 94 and 95 has been selected to minimize their acoustical effect. For example, from FIG. 9 it can be seen that receiving hole 49, and hence adjusting bolt 94, is positioned beneath center line 76 and inwardly of the point where support blocks 36 and 36*b* join base table 43 to tapered sound diaphragm 23. Similarly, receiving holes 48 and 50, and hence height adjusting bolts 93 and 95, are positioned slightly inwardly of the points where supporting block 30 is secured between tapered sound diaphragm 23 and base table 43.

The round head bolts mechanically engage tee nuts 51, 52 and 53 which are recessed into body 2. See FIG. 7*b* and 8. Clearance holes 84, 85 and 86 in the body 2 allow the full range of travel of round head bolts 93, 94 and 95 for variably raising or lowering dynamic tone engendering structure 10 relative to the top surface of the body 2.

Piezo Sensing Elements

In bridge piece 14 of FIG. 12*a*, piezo sensing element 59 is disposed between summing member 22 and massive base table 43. Massive base table through-hole 117 provides an exit for piezo sensing element output cables 98, 99 and 100. See FIGS. 9 and 10.

Figure 12B:
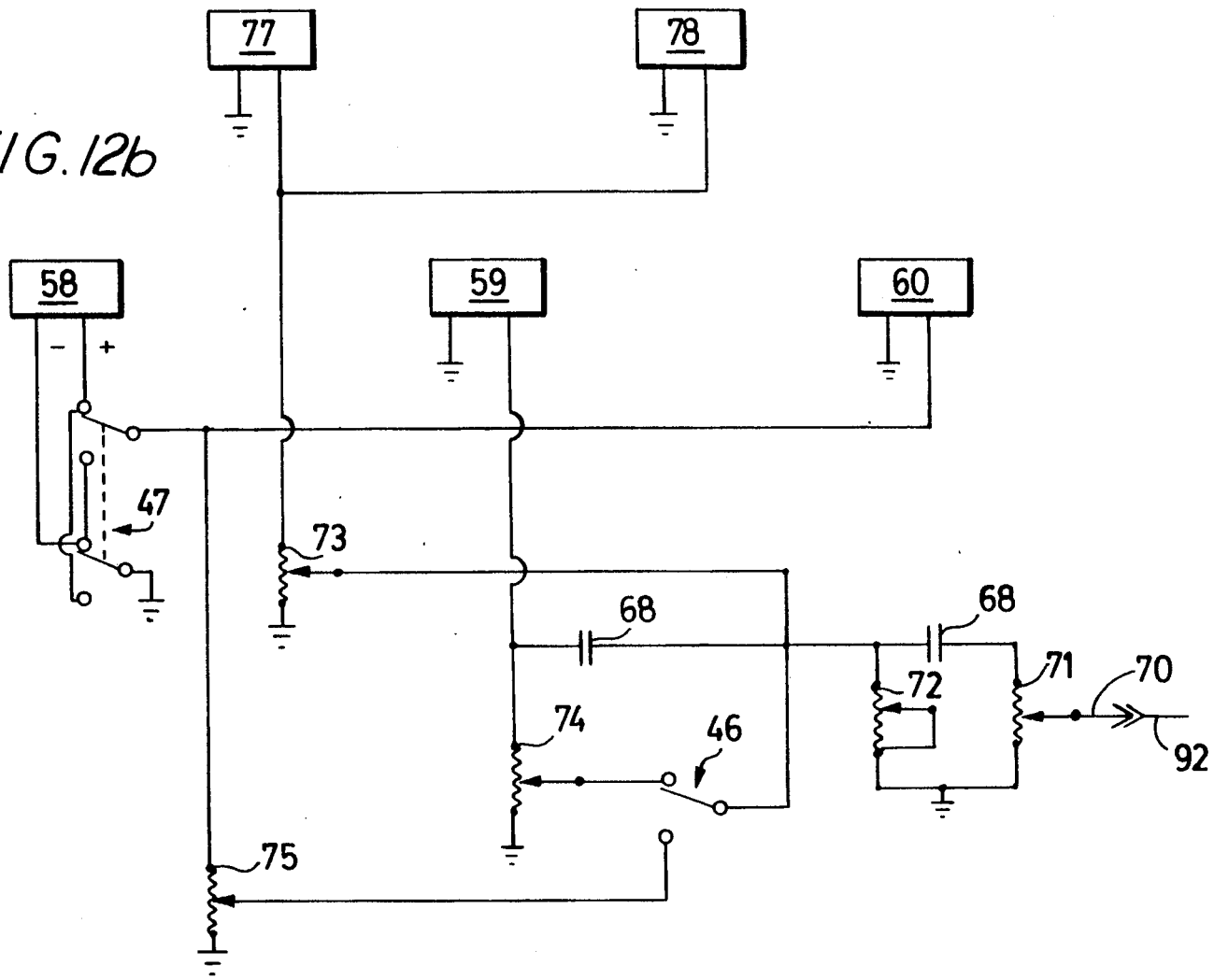
FIG. 12*b* is a schematic diagram of the electronic sensing, conditioning and control circuitry of the present invention.

In FIGS. 10 and 12 it can be seen that piezo transducers 58, 59 and 60 are disposed beneath tapered sound diaphragm 23 and rest upon renitent foundation means 27*a*, 27*b* and 27*c* which, in turn, are in contact with the massive base table 43. Renitent foundation means 27*a*, 27*b* and 27*c* can be formed of pads of double sided adhesive foam tape manufactured by Minnesota Mining and Manufacturing Company of St. Paul, Minn. Through-holes 118 and 119 in massive base table 43 provide exits for piezo transducer output cables 101 and 102 respectively. All piezo element output cables may be routed to through-holes within the body 2 and to various control circuits therein, as is well known to those skilled in the art. The user may access external controls via external control cluster 61, as illustrated in FIGS. 2–4.

While it is possible to position piezo transducers 58 and 60 in various locations between massive base table 43 and tapered sound diaphragm 23, it has been found that optimum results are achieved by placing piezo transducers 58 and 60 beneath unsupported leaves 37 and 38.

Figure 31:
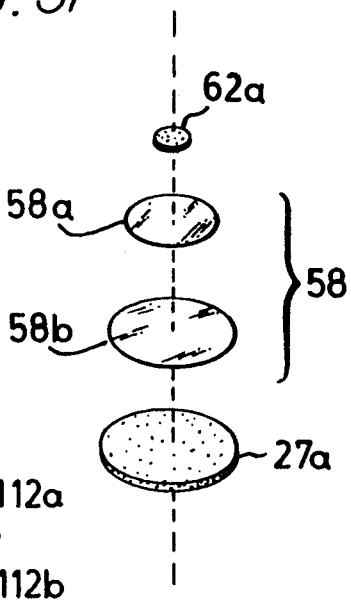
FIG. 31 is an exploded view of a typical piezo element used in the present invention.

In the preferred embodiment of the present invention, thin wafer piezo electric discs may be employed as transducers 58, 59 and 60, and 77 and 78. The thin wafer piezo ceramic material may be typically of a thickness between 3 and 20 mils and is typically bonded to a brass substrate of similar thickness. A typical structure is shown in FIG. 31, in exploded form, for transducer 58, it being understood that transducers 59, 60, 77 and 78 can have similar structures. In FIG. 31, a pill-shaped element 62*a* is provided to make contact between summing node 63 of bridge piece 14 and piezo disc 58*a*. Pill-shaped structure 62*a* can be constructed of neoprene. Piezo disc 58*a* is bonded to substrate 58*b*. Renitent foundation 27*a* provides resilient support for biasing the structure against the summing node 67. In the case of transducers 77 and 78, it is to be understood that instead of a circular in shape, the various components shown in FIG. 31 would have a generally rectangular shape to conform to the shape of slots 18*a* and 19*a*, FIG. 8.

Thin wafer piezo ceramic material such as PZT5 ®, available from Vernitron Piezo Electric, of Bedford, Ohio, is preferred as it exhibits high electrical output. In thin wafer form, PZT5 ® provides mechanical impedances which enable sampling of acoustical energies present in and upon the vibratile structures of the present invention with minimal interference with their vibration. Typical pressures occurring at the acoustical summing nodes 63, 64, 65, 66, and 67, constituting interfaces between the vibratile structures and the thin wafer piezo ceramic transducers, are less than 1 gram per $cm^2$.

Piezo films displaying very low mechanical impedance such as Keynar® piezo film may also be used, however mechanical impedances below those exhibited by thin ceramic materials do not offer significant improvements and generally produce lower electrical output signals with increased noise.

Piezo transducers 105 and 106*a*, FIG. 16, may be constructed of thicker ceramic material, however the electrical properties of all transducers should be such that their operating output impedances match each other. In this way the various piezo elements will not adversely affect each other's electrical signal output.

As can be seen in FIGS. 10 and 12*a*, piezo transducers comprise commercially available bonded ceramic and brass elements 58, 59 and 60 and 77 and 78, renitent foundation means 26*a* and 26*b* and 27*a*, 27*b* and 27*c* provide resilient support for maintaining positive mechanical contact between summing member 22 and summing nodes 63, 64, 65, 66 and 67. It is to be understood that various numbers and types of transducer means may be applied to the present invention.

Further, the present invention may be constructed with piezo transducer 60 as the sole electrical transducer. The present invention may then be bowed or plucked as piezo element 60 will sum both vertical and horizontal string vibrations as a result of bowing and plucking respectively. Substitute transducer structures may be placed in many locations provided by the present invention and not illustrated herein.

Ceramic piezo transducers are shown only as one possible method for converting acoustical energy present within and upon the vibratile structures of the present invention to electrical energy.

Control Circuits

As can be seen in FIGS. 12 and 16, examples of simple control circuits are shown wherein the outputs of piezo transducers 58, 59, 60, 77 and 78, and/or piezo transducers 103 and 104, may be variably added or subtracted from the total output signal. The signals produced by piezo transducers 58 and 60 may be routed through variable resistor 75 and adjustably attenuated such that they add with the filtered output of piezo transducer 59. In this way the present invention may be bowed or plucked without resetting switches or controls.

This is possible because the frequencies and voltages of the outputs of piezo elements 58 and 60 will differ from the frequencies and voltages produced by piezo element 59. Further, the frequency content of piezo element 59 may be selected by the value of capacitor 68 such that a smooth frequency crossover between the output of piezo elements 59 and 58 and 60 occurs. In this way, phase cancellation between the outputs is substantially eliminated in both bowed and plucked operation. In one embodiment of the present invention, this crossover frequency is selected to be about 400–800 Hz, for the double bass example, although such frequency will differ from instrument to instrument.

Piezo transducers 77 and 78, FIG. 12, enable the very high audio frequency energy present mainly on the bridge piece 14 to be adjustably added into the signal by means of high frequency blend control potentiometer 73. Further, piezo transducers 77 and 78, by virtue of their proximity to the strings, are least affected by residual resonances and reverberations in the various sound transmitting structures of the present invention, therefore their outputs furnish substantially pure sampling of the string vibration.

It is foreseen that various pickup elements may be placed in close proximity to the strings for providing an immediate and intimate detection of the vibration of the strings. While the unfiltered electrical signals produced by such placement of pickup elements typically do not provide accurate emulation of the timbre of traditional acoustic string instruments, it is anticipated that such close proximity pickups may be included for extending the musical capabilities and versatility of the present invention.

When bowing the present invention, side to side physical oscillations of the tapered sound diaphragm 23 predominate, thus causing a reciprocating physical displacement between acoustic summing nodes 65 and 63 on the undersurface of unsupported leaves 37 and 38 respectively. As resulting maximum downward force is applied to piezo transducer 60, minimum downward force is applied to piezo sensor 58, thus creating opposing electrical signals which cancel each other if piezo transducers 58 and 60 are electrically connected in polar phase. By inverting the electrical polarity of piezo transducer 58, by way of double pole, double throw switch 47, the electrical output signals of both piezo transducers 58 and 60 add together in phase, producing excellent response to the bow.

However, when the present invention is played by plucking the strings, the vibrating oscillations occurring at the sampling points 65 and 67 are not reciprocal but instead are in virtual unison with each other. Therefore piezo transducers 58 and 60 may be electrically connected in polar phase with respect to each other to cause their individual electrical output signals to add in phase. These polar phase relationships may be selectable by means of phase switch 47.

Referring to FIG. 12, piezo transducers 58 and 60 are primarily intended for transduction of the fundamental frequencies produced when bowing the strings 3, 4, 5, 6 and 7, thus piezo transducer 58 may typically be wired out of phase with respect to piezo transducer 60. However, it is foreseen that the phase of the electrical output of piezo transducer 58 may be phase delayed or inverted for response to plucking the strings. Piezo transducers 77 and 78 enable effective detection of the higher harmonics and subtle details produced by the strings. When the present invention is to be played by plucking the strings, switch 46 can be operated so that piezo transducers 58 and 60 are decoupled from the output. Thus, the output of piezo transducers 59, 77 and 78 only provide the output signal. This signal is substantially free of phase distortions and interactive loading affects such as occur in systems employing multiple transducers. The signal thus produced yields unrivaled clarity and coherence of sonic detail.

Signal coupling capacitor 68 forms a high pass filter which allows the upper partial frequencies sampled at summing member extension 22*a* by piezo transducer 59 to be added to the output signal regardless of the position of switch 46. Variable resistors 73, 74 and 75 enable adjustable voltage dividers to be placed in the signal path for purposes of adjustably attenuating the signal outputs of piezo transducers 58, 59 and 60 and 77 and 78. These variable resistors also provide a discharge path and ground reference to the piezo transducers when they are electrically disconnected from the output signal line 70 by switch 46.

Variable resistors 71 and 72 are provided as well known volume and treble frequency rolloff controls. Treble frequency rolloff capacitor 69 is in parallel with variable resistors 73, 74 and 75 and in part establishes the rolloff frequency characteristics of the treble frequency rolloff control 72.

Dual Piezo Ceramic Elements

Figure 30:
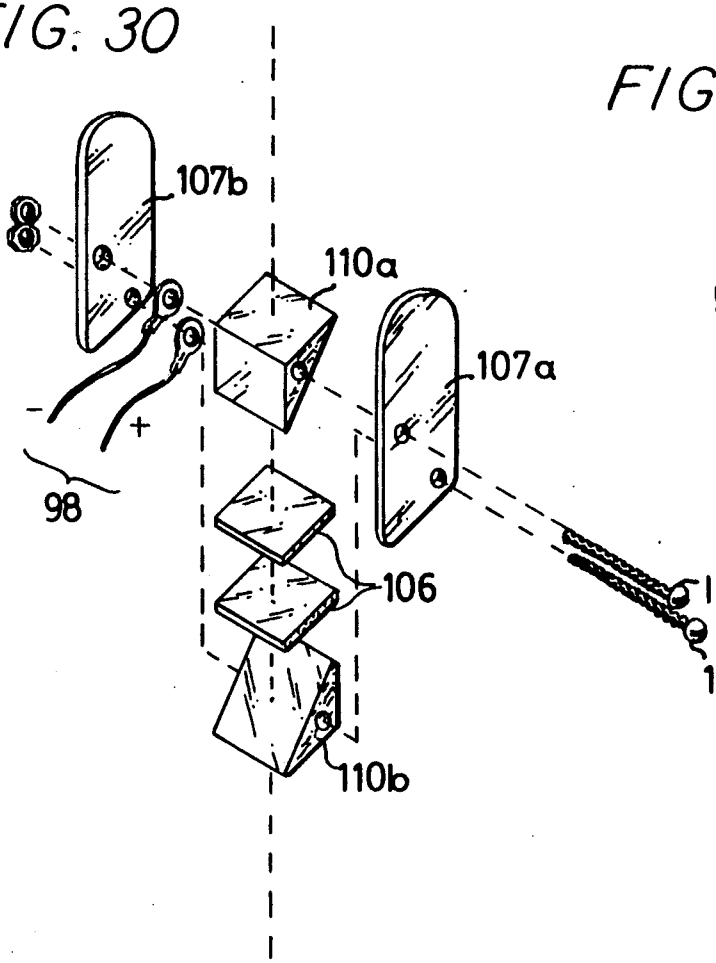
FIG. 30 is an exploded view of dual piezo structures suitable for use in the slidable acoustic energy conduits of FIG. 16.

When the present invention is constructed to include slidable acoustic energy conduits 103 and 104, piezo elements 77 and 78 may be substituted for by dual piezo elements 105 and 106, FIG. 16, each of which may consist of two laminated sheets of ceramic such as PZT5 ®. The dual piezo ceramic elements 105 and 106 may be mounted within slidable acoustic energy conduits 103 and 104. Outer plates 107*a* and 107*b* and 108*a* and 108*b*, FIG. 14, may be constructed of a non-conducting material, such as polycarbonates or phenolic, and are held captive to 45 degree aluminum angle slugs 109*a* and 109*b* and 110*a* and 110*b* by plate fasteners 111*a*, 111*b*, 111*c* and 111*d* and 112*a*, 112*b*, 112*c* and 112*d*, FIG. 16. Aluminum angle slug through-holes 113*a* and 113*b*, and 114*a* and 114*b* are drilled slightly oversized to allow pressure exerted by the strings 3, 4, 5, 6 and 7 to bear upon dual piezo elements 105 and 106. The 45 degree attitude of dual piezo elements 105 and 106 enables horizontal as well as vertical displacements of the bridge piece 14 to physically distort dual piezo elements 105 and 106, thus producing equal electrical signal output levels for both bowed and plucked strings. An exploded view of the piezo element 10 and associated supporting structure is provided in FIG. 30.

FIG. 16 shows a combined cross sectional view of the bridge 14, tapered sound diaphragm 23 and massive base table 43 with a schematic electrical circuit diagram wherein potentiometer 73 and filter capacitor 120 constitute a known variable frequency high pass filter for the output signal of dual piezo elements 105 and 106. This variable high pass filter enables the user to select the frequency content of the output of dual piezo elements 105 and 106 to be added to the main output signal. External control cluster 61, depicted in FIGS. 2–4, may include volume control 71, tone control 72 and switch 47 or alternately volume control 71, variable high pass filter 73 and switch 47. Other external controls may be readily adapted to the present invention to suit the user. Output jack 92 may be mounted on body 2 and may provide a disengageable connection to outside audio systems.

It is to be clearly understood that the configurations of piezo transducers and their signal output networks described herein are used only as illustrative examples of a preferred embodiment of the present invention. It is clearly foreseen that automated electronic switches may be substituted for switches 46 and 47. Phase switch 47 may be readily substituted by phase altering devices such as time delay devices, circuits or the like for providing various phase relationships between the outputs of piezo transducers 58, 59 and 60. The various vibratile structures shown in this illustrative example of the present invention furnish many opportunities for sampling and converting to electrical signals the acoustical energies occurring therein and it is clearly foreseen that differing or additional transducer means may be operatively associated with the various structures of the present invention and be well within the scope and spirit of the present invention.

Further Alternative Embodiment

Figures 28, 29:
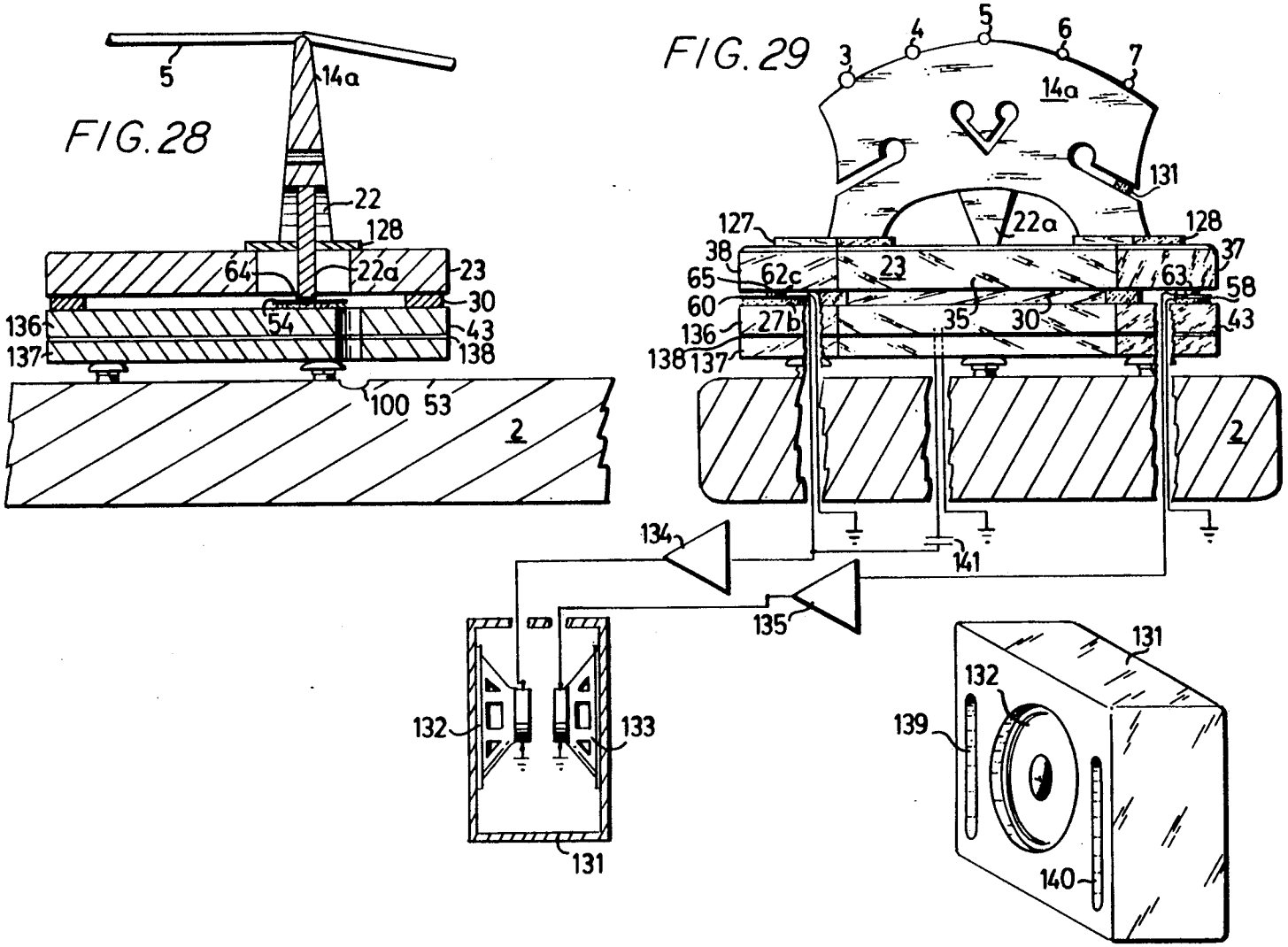
FIG. 28 is a cross sectional view illustrating a further embodiment of the base table of the present invention.
FIG. 29 is a rear view of the embodiment of FIG. 28 and an illustration of the use of a stereo dipolar speaker in the present invention.

In FIGS. 28 and 29, the dynamic tone engendering means 10 of the present invention is shown with a bridge piece 14*a* including cork acoustic coupling 142 between the bridge crown and foot on the treble side of the bridge piece. Thus, acoustical energies produced by the treble string 7 are given an improved pathway to piezo element 60 and as an added benefit, resonances occurring in the bridge piece are damped.

With the exception of this improved coupling of the energy of treble string 7, the bridge piece as shown in FIG. 29 produces playing response closely resembling a traditional violin family string instruments, however the size and mass of the bridge piece 14*a* has been greatly reduced compared with traditional violin bridges. This facilitates coupling of the vibrating string's acoustical energy to the acoustical summing nodes 63, 64 and 65 and piezo elements 59 and 60 and combined soundpost and piezo element 58*a* in FIG. 29.

When comparing the present invention with traditional string musical instruments it is helpful to understand that traditional acoustical instruments generally use bridge structures for coupling the string's vibrations to large surfaces, thus these bridges must distribute or spread the acoustical energy for maximizing the effects of the vibrating strings upon the large acoustic plates which produce the sound in these traditional string musical instruments.

In the present invention the bridge piece focuses the vibrational energies of the strings into and onto relatively small areas compared to acoustic string instruments. The structures of the present invention are configured for producing resonant colorations and tactile response which are closely related to those produced by acoustical string instruments.

Experiments and performance trials using traditional bass violins have shown that the dispersion of acoustical energy into the surrounding air during performance is multi-directional. Sound energy is radiated by both the top plate and the back plate. Further, the resonant cavity of the body contains an air mass which reacts to the movement of both the front and back plates. The top plates includes two "F" holes which serve to enhance the compliance of the top plate and also furnishes an exit for sound generated in the air mass within the body cavity. Within the body cavity a soundpost mechanically couples energy emanating from the treble foot of the bridge to the back plate. The soundpost thus stiffens the top under the treble foot and couples acoustic wave fronts travelling along the axis common to the soundpost to the back. The back thus responds to vibration in the vertical axis common to the soundpost. The top plate of the bass violin is responsive to the horizontal wave fronts which travel perpendicular to the wave fronts travelling on the axis of the soundpost. This is because the bass foot of the bridge rests upon an unsupported portion of the top plate which allows much greater movement than the treble foot of the bridge which rests near the soundpost. While there is a structure called the "bass bar" under the bass foot of the, this structure serves primarily to unify the displacements of the top plate caused by the horizontal displacements of the bridge and the soundpost acts much like a pivot point for these horizontal movements of the bridge.

Dipolar Speaker Pattern

Due to the complexity of the foregoing acoustical system, it is unreasonable to assume that single loudspeaker will produce a sonic situation in absolute accordance with that of an acoustic string bass, however use of two speakers in an enclosure designed to radiate in a dipolar pattern allows the outputs of the piezo electric element of the present invention to produce an effect very similar to an acoustic bass violin.

The horizontal wave fronts produced by bowed strings and the vertical wave fronts produced by plucked strings may produce undesirable phase cancellations and additions when the piezo pickup output signals are mixed together in a monophonic system. While it is possible to use high pass filters on piezo elements 58 and 59 to alleviate this problem, it is foreseen that stereophonic amplifiers 134 and 135 of known kind may be combined with special speaker enclosure 131 for attainment of an acoustical situation very close to that which is produced by an acoustic double bass.

As shown in FIGS. 28 and 29, three piezo elements are disposed within dynamic tone engendering means 10. Horizontal perturbations of the strings cause the bass side of the bridge 14 to excite the unsupported leaf 37 (treble side) of the tapered sound diaphragm 23 thus setting piezo element 60 into motion. Combined piezo element and soundpost 58*a* in FIG. 29 acts as a pivot for bridge piece 14*a* and produces voltages analogous to vertical pressure fronts emanating from the vibrating strings.

The combined soundpost and piezo element 58*a* should be much stiffer than piezo element 60. Piezo element 60 should not unduly damp the motions of unsupported leaf 38 (bass side). While combined piezo soundpost must significantly dampen the motions of unsupported leaf 37, the outputs from piezo element 60 and combined soundpost and piezo element 58*a* are each separately connected to amplifiers and then to the stereophonic dipolar speaker enclosure 131.

The output of the center piezo element 59 may be sent through a high pass filter 141 and then added to both the outputs of piezo element 60 and combined soundpost and piezo element 58*a* for enhanced detail and harmonic content. Stereo dipolar speaker enclosure 131 may consist of two loudspeakers: a first speaker 132 mounted on a front panel which includes two slots 139 and 140 for allowing the air mass within the enclosure to couple to the outside air, and a second speaker 133 mounted on a rear panel with no openings other than a circular speaker hole. Thus the rear speaker 133 radiates the acoustical information analogous to the back of a traditional bass violin while the front speaker 132 and slots radiate the acoustical information analogous to the top and "F" holes of a traditional double bass.

As shown in FIGS. 28 and 29, massive bass table 43 is composed of two laminated plates 136 and 137, preferably each of dissimilar resonant frequencies with a layer of resilient material 138 separating the plates from each other. In this way, undesirable acoustic resonances within massive base table 43 are substantially eliminated. Best results are achieved when a silicone rubber is used for resilient material layer 138. Laminated plates 136 and 137 should be constructed of stiff materials displaying high damping factors. Among such materials are birch or hickory plywood, however it is foreseen that cast composite materials may be used with good results.

The terms and expressions which have been employed herein are used as terms of description and not of limitation, and there is no intention in the use of such terms and expressions of excluding equivalents of the features shown and described, or portions thereof, it being recognized that various modifications are possible within the scope of the invention claimed.

I claim:

1. A tone engendering structure for converting vibrational energy received from a plurality of vibrating strings into an electrical signal which is suitable for amplification, comprising a base table formed of high-mass density material;

a sound diaphragm supported by the base table and constructed of material with a mass density lower than the high mass density material, wherein the sound diaphragm is separated into a plurality of distinct sections by an acoustic boundary slot so that the plurality of distinct sections have different resonant frequencies and form interactive resonant structures;

a bridge assembly communicating with the plurality of vibrating strings, wherein selected portions of the bridge assembly are supported on selected ones of the plurality of distinct sections of the sound diaphragm so that vibrational energy from selected ones of the plurality of strings are predominantly transmitted to the selected ones of the plurality of distinct sections of the sound diaphragm; and transducer means communicating with at least one section of the sound diaphragm for converting vibrational energy from the sound diaphragm into electrical signals.

2. The apparatus as recited in claim 1, further including second transducer means positioned between the sound diaphragm and the base table for converting vibrational energy from the sound diaphragm into electrical signals.

3. The apparatus as recited in claim 1, wherein the plurality of distinct sections of the sound diaphragm include a treble section which is resonant in the treble frequency range, a bass section which is resonant in the bass frequency range, and a connecting section, each section having a trapezoidal shape.

4. The apparatus as recited in claim 3, wherein the treble section and the bass section of the sound diaphragm are separated by the acoustical boundary slot.

5. The apparatus as recited in claim 4, wherein the sound diaphragm has a generally hexagonal shape with at least two sides of unequal length, and two sides which are parallel to one another, and wherein the acoustic boundary slot divides one of the sides.

6. The apparatus as recited in claim 5, wherein the acoustic boundary slot bisects one of the two parallel sides, extends toward the other of the two parallel sides, and terminates at an interior end, so that the treble and bass sections of the sound diaphragm lie on either side of the acoustical boundary slot, the connecting section lies between the other of the two parallel sides and the interior end of the acoustical boundary slot, and the connecting section acoustically couples the bass section to the treble section.

7. The apparatus as recited in claim 6, wherein the sound diaphragm is supported with respect to the base table along the two parallel ends and so that the supporting means of the bridge assembly are positioned over unsupported sections of the sound diaphragm.

8. The apparatus as recited in claim 3, wherein the bridge assembly includes a bridge piece having a first edge positioned to be in contact with the plurality of strings and a second edge separated from the first edge by vibration transmitting material; and acoustic conduit means for conducting vibrational energy from selected areas of the bridge piece to the sound diaphragm.

9. The apparatus as recited in claim 8, wherein the acoustic conduit means are movably positionable to be in contact with selected areas of the second edge of the bridge piece for supporting the bridge piece on the sound diaphragm and for conducting vibrational energy from the selected areas of the bridge piece to the sound diaphragm, wherein the selected areas of contact selectively affect transmission of the acoustic energy from particular ones of the vibrating strings to the sound diaphragm.

10. The apparatus as recited in claim 8, wherein a plurality of slots are positioned in the bridge piece to form the acoustic conduit means which direct vibrational energy from selected portions of the first edge toward selected portions of the second edge; and further including means positioned to be in contact with the second edge of the bridge piece for supporting the bridge piece on the sound diaphragm.

11. The apparatus as recited in claim 10, further including third transducer means positioned in selected ones of the plurality of slots in the vibration transmitting material of the bridge piece for converting vibrational energy in the vibration transmitting material into electrical signals.

12. The apparatus as recited in claim 10, wherein the supporting means are positioned to permit vibrations from selected portions of the second edge of the bridge assembly to be transmitted to and to interact with vibrational energy from selected ones of the plurality of distinct sections of the sound diaphragm.

13. The apparatus as recited in claim 12, wherein the supporting means are positioned relative to the second edge of the bridge assembly and the selected ones of the plurality of distinct sections of the sound diaphragm in order to enhance the transmission and interaction of vibrational energy from selected ones of the plurality of strings.

14. The apparatus as recited in claim 12, wherein the supporting means are positioned relative to the second edge of the bridge piece and the selected ones of the plurality of distinct sections of the sound diaphragm in order to diminish the transmission and interaction of vibrational energy from selected ones of the plurality of strings.

15. The apparatus as recited in claim 12, wherein the plurality of strings include a first set of strings which are constructed to vibrate over a range of treble frequencies and a second set of strings which are constructed to resonate over a range of bass frequencies, and further wherein the supporting means are positioned to transmit vibrational energy from the first set of strings to the treble section of the sound diaphragm, and to transmit vibrational energy from the second set of strings to the bass section of the sound diaphragm.

16. The apparatus as recited in claim 10, wherein the bridge piece further includes a summing member extension and which protrudes outwardly from the second edge, and wherein the apparatus further includes second transducer means positioned to be in communication with the summing member extension for converting vibrational energy from the summing member extension into electrical signals.

17. The apparatus as recited in claim 16, wherein the plurality of strings include strings which are constructed to resonate over different portions of a range of frequencies, and further wherein the plurality of slots in the vibration transmitting material of the bridge piece are positioned to enhance the transmission of vibrations from selected ones of the plurality of strings to the summing member extension.

18. The apparatus as recited in claim 16, wherein the plurality of strings include strings which are constructed to resonate over different portions of a range of frequencies, and further wherein the plurality of slots in the vibration transmitting material of the bridge piece are positioned to diminish the transmission of vibrations from selected ones of the plurality of strings to the summing member extension.

19. The apparatus as recited in claim 16, wherein the plurality of strings include strings which are constructed to resonate over different portions of a range of frequencies, and further wherein the supporting means are positioned to support selected sections of second edge of the bridge piece so that the transmission of vibrations from selected ones of the plurality of strings to the summing member extension is diminished.

20. The apparatus as recited in claim 16, wherein the plurality of strings include strings which are constructed to resonate over different portions of a range of frequencies, and further wherein the supporting means are positioned to support selected sections of second edge of the bridge piece so that the transmission of vibrations from selected ones of the plurality of strings to the summing member extension is enhanced.

21. The apparatus as recited in claim 1, wherein the base table includes a first plate of high mass density material;

a second plate of high mass density material; and a layer of resilient material sandwiched between the first and second plates.

22. The apparatus as recited in claim 21, wherein the first plate is constructed of a high-mass density material having a first resonant frequency and the second plate is constructed of a high-damping factor material having a second resonant frequency different from first resonant frequency.

23. The apparatus as recited in claim 22, wherein the high-mass density materials of the first and second plates is birch or hickory plywood.

24. The apparatus as recited in claim 22, wherein the high-mass density materials of the first and second plates is a cast synthetic composite material.

25. The apparatus as recited in claim 21, wherein the layer of resilient material is constructed of acoustically absorbent Sorbothane®.

26. A string musical instrument including a body;

a neck coupled to one end of the body;

a plurality of strings which extend under tension across the neck and body; and a bridge structure communicating with the plurality of strings for converting vibrational energy from the plurality of strings into electrical signals which are suitable for amplification, the bridge structure comprising a base table supported on the body and constructed of high damping-factor material;

a sound diaphragm having an asymmetrical shape and supported on the base table, wherein the sound diaphragm is constructed of a plate of low mass density material having a mass density lower than the mass density of the high damping-factor material, and further wherein the plate is separated into a plurality of acoustically distinct sections by an acoustic boundary slot;

a bridge assembly supported on the sound diaphragm and in contact with the plurality of strings for transferring energy from the plurality of strings to the sound diaphragm; and transducer means positioned at selected locations on the bridge structure for converting vibrational energy present at the selected locations into electrical signals.

27. The apparatus of claim 26, wherein the bridge assembly includes a bridge piece having a first edge positioned to be in contact with the plurality of strings and a second edge separated from the first edge by vibration transmitting material, the bridge piece having a summing member extension which protrudes outwardly from the second edge, and further wherein the vibration transmitting material includes a plurality of slots which are positioned to direct vibrational energy from selected portions of the first edge toward selected portions of the second edge; and means positioned to be in contact with the second edge of the bridge piece for supporting the bridge piece on the sound diaphragm and for transferring energy from the bridge piece to the sound diaphragm.

28. The apparatus as recited in claim 27, wherein the base table includes a first plate of high mass density material;

a second plate of high mass density material; and a layer of resilient material sandwiched between the first and second plates.

29. The apparatus of claim 26, wherein the bridge assembly includes a bridge piece having a first edge positioned to be in contact with the plurality of strings and a second edge separated from the first edge by vibration transmitting material; and acoustic conduit means movably positionable to be in contact with selected areas of the second edge of the bridge piece for supporting the bridge piece on the sound diaphragm and for conducting vibrational energy from the selected areas of the bridge piece to the sound diaphragm, wherein the selected areas of contact selectively affect transmission of the acoustic energy from particular ones of the vibrating strings to the sound diaphragm.

30. A tone engendering structure for converting vibrational energy received from a plurality of vibrating strings into an electrical signal which is suitable for amplification, comprising a base table formed of high mass density material;

a sound diaphragm constructed of low mass density material having a mass density lower than the high mass density material and supported by the base table so that the sound diaphragm is an acoustically excitable structure;

means supported by the sound diaphragm and communicating with the plurality of vibrating strings for transferring the vibrational energy from the plurality of strings to the sound diaphragm, including a bridge piece having a first edge positioned to be in contact with the plurality of strings and a second edge separated from the first edge by vibration transmitting material, the bridge piece having a summing member extension which protrudes outwardly from the second edge, and further wherein the vibration transmitting material includes a first bridge piece section upon which is located the first edge of the bridge piece;

a second bridge piece section upon which is located the second edge of the bridge piece; and a plurality of slidable energy conduit means which coupled the first bridge piece section to the second bridge piece section;

wherein the first and second bridge piece sections are positioned to direct vibrational energy from selected portions of the first edge of the bridge piece toward selected portions of the second edge of the bridge piece;

means positioned to be in contact with the second edge of the bridge piece for supporting the bridge piece on the sound diaphragm; and first transducer means in communication with the summing member extension of the transferring means for converting vibrational energy from the summing member extension into electrical signals.

31. A tone engendering structure for converting vibrational energy received from a plurality of vibrating strings into an electrical signal which is suitable for amplification, comprising a base structure formed of high mass density material;

a sound diaphragm constructed of low mass density material having a mass density lower than the high mass density material and spaced apart from the base structure so that the sound diaphragm is allowed to vibrate;

means supported by the sound diaphragm and communicating with the plurality of vibrating strings for transferring the vibrational energy from the plurality of strings to the sound diaphragm, including a bridge piece having a first edge positioned to be in contact with the plurality of strings and a second edge separated from the first edge by vibration transmitting material, the bridge piece having a summing member extension which protrudes outwardly from the second edge, and further wherein the bridge piece has a plurality of predetermined areas from which the vibration transmitting material has been removed so that vibrational energy from selected portions of the first edge is conducted toward selected portions of the second edge;

means positionable to be in contact with the second edge of the bridge piece for supporting the bridge piece on the sound diaphragm; and first transducer means in communication with the summing member extension of the transferring means for converting vibrational energy from the summing member extension into electrical signals.

32. The apparatus as recited in claim 31, further including second transducer means positioned in selected ones of the plurality of areas from which vibrational transmitting material has been removed in the bridge piece for converting vibrational energy in the vibration transmitting material into electrical signals.

33. The apparatus as recited in claim 31, wherein the plurality of strings include strings which are constructed to vibrate over different portions of a range of frequencies, and further wherein the plurality of areas from which the vibration transmitting material has been removed in the bridge piece are positioned to enhance the transmission of vibrations from selected ones of the plurality of strings to the summing member extension.

34. The apparatus as recited in claim 31, wherein the plurality of strings include strings which are constructed to vibrate over different portions of a range of frequencies, and further wherein the plurality of slots in the vibration transmitting material of the bridge piece are positioned to diminish the transmission of vibrations from selected ones of the plurality of strings to the summing member extension.

35. The apparatus as recited in claim 31, wherein the plurality of strings include strings which are constructed to vibrate over different portions of a range of frequencies, and further wherein the supporting means are positioned to support selected sections of the second edge of the bridge piece so that transmission of vibrations from selected strings to the summing member extension is diminished.

36. The apparatus as recited in claim 31, wherein the plurality of strings includes strings which are constructed to vibrate over different portions of a range of frequencies, and further wherein the supporting means are positioned to support selected sections of the second edge of the bridge piece so that transmission of vibrations from selected strings to the summing member extension is enhanced.

37. The apparatus as recited in claim 31, further including third transducer means positioned between the sound diaphragm and the base table for converting vibrational energy from the sound diaphragm into electrical signals.

38. The apparatus as recited in claim 37, wherein the sound diaphragm is separated into a plurality of distinct sections by an acoustic boundary slot.

39. The apparatus as recited in claim 38, wherein the supporting means are positioned to permit vibrations from selected portions of the second edge of the bridge piece to be transmitted to and to interact with selected ones of the plurality of distinct sections of the sound diaphragm.

40. The apparatus as recited in claim 39, wherein the supporting means are positioned relative to the second edge of the bridge piece and the selected ones of the plurality of distinct sections of the sound diaphragm in order to enhance the transmission and interaction of vibrations from selected ones of the plurality of strings.

41. The apparatus as recited in claim 39, wherein the supporting means are positioned relative to the second edge of the bridge piece and the selected ones of the plurality of distinct sections of the sound diaphragm in order to diminish the transmission and interaction of vibrations from selected ones of the plurality of strings.

42. The apparatus as recited in claim 31, wherein the base table includes a first plate of high mass density material;

a second plate of high mass density material; and a layer of damping material sandwiched between the first and second plates.

43. The apparatus as recited in claim 42, wherein the first plate is constructed of a high-mass density material having a first resonant frequency and the second plate is constructed of a high-mass density material having a second resonant frequency different from first resonant frequency.

44. The apparatus as recited in claim 42, wherein the high-mass density materials of the first and second plates is birch or hickory plywood.

45. The apparatus as recited in claim 42, wherein the high mass density materials of the first and second plates is a synthetic composite material.

46. The apparatus as recited in claim 42, wherein the layer of damping material is constructed of Sorbothane®.

47. A tone engendering structure for converting vibrational energy received from a plurality of vibrating strings into an electrical signal which is suitable for amplification, comprising a base structure formed of high mass density material;

a sound diaphragm constructed of low mass density material having a mass density lower than the high mass density material and spaced apart from the base structure so that the sound diaphragm is allowed to vibrate;

means supported by the sound diaphragm and communicating with the plurality of vibrating strings for transferring the vibrational energy from the plurality of strings to the sound diaphragm, including a bridge piece having a first edge positioned to be in contact with the plurality of strings and a second edge separated from the first edge by vibration transmitting material;

acoustic conduit means movably positionable to be in contact with selected areas of the second edge of the bridge piece for supporting the bridge piece on the sound diaphragm and for conducting vibrational energy from the selected areas of the bridge piece to the sound diaphragm, wherein the selected areas of contact selectively affect transmission of the acoustic energy from particular ones of the vibrating strings to the sound diaphragm; and first transducer means in communication with a summing area of the transferring means for converting vibrational energy from the summing area into electrical signals.

48. The apparatus as recited in claim 47, wherein the plurality of strings include strings which are constructed to vibrate over different portions of a range of frequencies, and further wherein the selected areas of contact are chosen to enhance the transmission of vibrations from selected ones of the plurality of strings to the sound diaphragm.

49. The apparatus as recited in claim 47, wherein the plurality of strings include strings which are constructed to vibrate over different portions of a range of frequencies, and further wherein the selected areas of contact are chosen to diminish the transmission of vibrations from selected ones of the plurality of strings to the sound diaphragm.

50. The apparatus as recited in claim 47, further including transducer means positioned between the sound diaphragm and the base table for converting vibrational energy from the sound diaphragm into electrical signals.

51. The apparatus as recited in claim 47, wherein the sound diaphragm is separated into a plurality of distinct sections by an acoustic boundary slot, including a bass section and a treble section.

52. The apparatus as recited in claim 51, wherein the acoustic conduit means are positioned to permit vibrations from the selected areas of contact of the second edge of the bridge piece to be transmitted to and to interact with selected ones of the plurality of distinct sections of the sound diaphragm.

53. The apparatus as recited in claim 52, wherein the acoustic conduit means are positioned relative to the second edge of the bridge piece and the selected ones of the plurality of distinct sections of the sound diaphragm in order to enhance the transmission and interaction of vibrations from selected ones of the plurality of strings.

54. The apparatus as recited in claim 53, wherein the acoustic conduit means are positioned relative to the second edge of the bridge piece and the selected ones of the plurality of distinct sections of the sound diaphragm in order to diminish the transmission and interaction of vibrations from selected ones of the plurality of strings.

55. The apparatus as recited in claim 47, wherein the base table includes a first plate of high mass density material;

a second plate of high mass density material; and a layer of damping material sandwiched between the first and second plates.

56. The apparatus as recited in claim 55, wherein the first plate is constructed of a high-mass density material having a first resonant frequency and the second plate is constructed of a high-mass density material having a second resonant frequency different from first resonant frequency.

57. The apparatus as recited in claim 56, wherein the high-mass density materials of the first and second plates is birch or hickory plywood.

58. The apparatus as recited in claim 56, wherein the high-mass density materials of the first and second plates is a synthetic composite material.

59. The apparatus as recited in claim 55, wherein the layer of damping material is constructed of Sorbothane®.

60. The apparatus as recited in claim 47, further including a slidable miniature sound post positioned between the treble section of the sound diaphragm and the base table; and a damping pad positioned between the bass section of the sound diaphragm and the base table.

61. The apparatus as recited in claim 47, further including scuff pads means positioned between the acoustic conduit means for providing a surface upon which the acoustic conduit means can slide and for assisting in dampening residual vibrations from the sound diaphragm.

* * * * *